US008870002B2

(12) United States Patent
Wilt et al.

(10) Patent No.: US 8,870,002 B2
(45) Date of Patent: Oct. 28, 2014

(54) RAILROAD FREIGHT CAR DRAFT GEAR ASSEMBLY

(75) Inventors: Donald E. Wilt, Batavia, IL (US); Keith A. Salis, Clare, IL (US); Lawrence W. Hanson, Amboy, IL (US)

(73) Assignee: Miner Enterprises, Inc., Geneva, IL (US)

( * ) Notice: Subject to any disclaimer, the term of this patent is extended or adjusted under 35 U.S.C. 154(b) by 349 days.

(21) Appl. No.: 13/374,160

(22) Filed: Dec. 14, 2011

(65) Prior Publication Data

US 2013/0153526 A1 Jun. 20, 2013

(51) Int. Cl.
*B61G 9/00* (2006.01)

(52) U.S. Cl.
USPC ..... 213/22; 213/40 R; 213/33; 213/32 R

(58) Field of Classification Search
USPC ..... 213/22, 23, 24, 32 R, 33, 34, 40 R, 40
See application file for complete search history.

(56) References Cited

U.S. PATENT DOCUMENTS

| | | | | |
|---|---|---|---|---|
| 1,894,716 | A * | 1/1933 | Sproul | 267/203 |
| 2,667,277 | A * | 1/1954 | Mulcahy | 213/32 R |
| 2,713,485 | A | 7/1955 | Tillou | |
| 3,581,909 | A * | 6/1971 | Peterson | 213/34 |
| 4,198,037 | A | 4/1980 | Anderson | |
| 4,304,397 | A * | 12/1981 | Zanow | 267/201 |
| 4,576,295 | A | 3/1986 | Carlstedt | |
| 4,591,059 | A * | 5/1986 | Hammarlund | 213/32 R |
| 4,735,328 | A * | 4/1988 | Carlstedt | 213/33 |
| 4,960,215 | A * | 10/1990 | Carlstedt | 213/33 |
| 5,104,101 | A | 4/1992 | Anderson et al. | |
| 5,351,844 | A * | 10/1994 | Carlstedt | 213/44 |
| 6,478,173 | B2 * | 11/2002 | Carlstedt | 213/32 C |
| 6,488,162 | B1 | 12/2002 | Carlstedt | |
| 6,520,360 | B1 | 2/2003 | Withall et al. | |
| 6,792,871 | B2 * | 9/2004 | O'Donnell et al. | 104/16 |
| 6,796,448 | B1 * | 9/2004 | Wilt et al. | 213/40 R |
| 6,862,999 | B2 * | 3/2005 | O'Donnell et al. | 105/199.3 |
| 6,877,623 | B2 | 4/2005 | Salis | |
| 7,044,061 | B2 * | 5/2006 | O'Donnell et al. | 105/199.3 |
| 7,624,884 | B2 * | 12/2009 | Palermo et al. | 213/22 |
| 8,328,030 | B2 * | 12/2012 | Kontetzki | 213/4 |
| 8,365,930 | B2 * | 2/2013 | Carlstedt | 213/44 |
| 8,590,717 | B2 * | 11/2013 | Wilt et al. | 213/22 |

(Continued)

FOREIGN PATENT DOCUMENTS

| | | |
|---|---|---|
| RU | 2173273 | 2/2000 |
| RU | 87765 | 10/2009 |

OTHER PUBLICATIONS

Eurasian Patent Office; Patent Search Report issued by the Eurasian Patent Office regarding related Eurasian patent application Serial No. 201201544; 1 page; Apr. 18, 2013.
English language transaltion of Cite DA.

*Primary Examiner* — Jason C Smith
(74) *Attorney, Agent, or Firm* — Law Office of John W. Harbst

(57) ABSTRACT

A railcar draft gear assembly having an axially elongated spring assembly comprised of an axially stacked array of individual spring units and further including cooperating instrumentalities for maintaining the spring assembly generally axially aligned with a longitudinal axis of the railcar draft gear assembly during operation of the draft gear assembly while maintaining the individual spring units in generally aligned relation relative to each other.

34 Claims, 14 Drawing Sheets

(56) References Cited

U.S. PATENT DOCUMENTS

2004/0173555 A1* 9/2004 Wilt et al. ..... 213/50
2008/0290058 A1* 11/2008 Palermo et al. ..... 213/32 C
2010/0059470 A1* 3/2010 Carlstedt et al. ..... 213/40 R
2012/0292279 A1* 11/2012 Wilt et al. ..... 213/22
2013/0153526 A1* 6/2013 Wilt et al. ..... 213/32 C
2013/0168346 A1* 7/2013 Wilt et al. ..... 213/22

* cited by examiner

RAILROAD FREIGHT CAR DRAFT GEAR ASSEMBLY

FIELD OF THE INVENTION DISCLOSURE

This invention disclosure generally relates to a railroad freight car draft gear assembly and, more specifically, to a railcar draft gear assembly which utilizes an axially elongated spring assembly and structure for maintaining the spring assembly generally axially aligned with a longitudinal axis of the railcar draft gear assembly during operation of the draft gear assembly.

BACKGROUND

A railroad freight car draft gear assembly has been used for many years at opposite ends of a railcar to absorb and cushion impact forces directed against and to the railcar. Most railcar draft gear assemblies include a housing having an inner tapered bore at an open end, an elongated spring disposed within the housing, a series of metal friction shoes or members arranged in the tapered bore of the housing and movable against the spring upon compression of the draft gear assembly, and a wedge or actuator disposed in operable combination with the friction members such that impact blows directed against the wedge are transferred axially to the spring and radially to the housing. In most railcar draft gear assemblies, a spring seat is arranged between an end portion of each friction member and the spring.

Recently, elastomeric materials have been used and accepted as replacements for steel springs. One elastomeric spring assembly offering beneficial results is disclosed in U.S. Pat. No. 5,351,844 to R. A. Carlstedt and includes multiple elastomeric spring units stacked in axial relation relative to each other. Each spring unit of the spring assembly includes an elastomer pad sandwiched between two metal plates. The metal plates are bonded or otherwise secured to opposed faces of the elastomer pad. Amongst other advantages, the metal plates serve to limit snaking and/or buckling problems while furthermore serving to center elastomeric spring assembly relative to the draft gear housing. Such a spring assembly has been successfully used for years in combination with railcar draft gears.

In one form, the draft gear housing is provided with an elongated opening between the closed end and open end of the housing and extending along a sidewall of the draft gear housing to allow the spring units to be inserted and stacked relative to each other within the draft gear housing. Maintaining the spring units in alignment relative to each other and generally centered relative to the longitudinal axis of the draft gear assembly is an important consideration when designing a railcar draft gear assembly. Moreover, maintaining the elongated spring assembly in relatively centered relationship relative to the longitudinal axis of the draft gear is also important to overall performance of the draft gear assembly.

The draft gear assembly is arranged within a pocket in the railcar and extends generally parallel to a longitudinal axis of the railcar. Accordingly, when the railcar travels through a curve, the railcar tends to impart unequal forces to the draft gear assembly. Such unequal forces applied to the draft gear assembly are also frequently transferred to the elongated spring assembly tending for the individual spring units to become misaligned relative to each other and relative to the longitudinal axis of the draft gear. As mentioned, displacement of the individual spring units relative to each other and relative to the longitudinal center of the draft gear assembly can result in undesirable overall performance of the railcar draft gear assembly.

Railcar manufacturers and suppliers for supplying such railcar manufacturers are continually seeking methods and ways of reducing the manufacturing costs of railcars and the components used to build such railcars without having to sacrifice performance and quality. When considering costs savings in connection with a draft gear assembly, however, the available options are few. First, the size of the draft gear housing cannot be changed without adversely affecting the relationship of the fixed size pocket in a railcar centersill wherein the draft gear assembly is accommodated. Second, and with the size of the draft gear assembly being standardized or fixed, the amount of steel used to form the draft gear housing has already been minimized as with openings and voids wherever possible. Exacerbating these design challenges is the fact that speeds of railcars are steadily increasing, thus, adding to the impact loads imparted to the draft gear assembly during railcar operation. As such, the size of the spring assembly used to absorb, dissipate and return energy imparted thereto during railcar operations cannot be reduced without adversely affecting performance and operation of the draft gear assembly.

Thus, there remains a continuing need and desire to provide a railcar draft gear which is economically designed to have high shock absorbing capacities while offering enhanced performance by maintaining the spring units of the elongated spring assembly in aligned relation relative to each other and relative to the longitudinal axis of the draft gear assembly.

SUMMARY

According to one aspect, there is provided a railroad freight car draft gear assembly including a hollow housing closed at a first end and open toward a second end, with the housing defining a longitudinal axis for the draft gear assembly. A series of friction members are radially spaced about the longitudinal axis of the draft gear and are arranged in operable combination with the open end of the housing. A wedge is arranged for axial movement relative to the open end of the housing and against which an exterior force can be applied after the draft gear assembly is arranged in operable combination with a railcar. In a manner known in the art, the wedge is arranged in operable combination with the series of friction members.

A spring assembly is disposed within the hollow housing for storing energy applied to the wedge during axial compression of the draft gear assembly. A first end of the spring assembly is arranged in operable contacting relation with the closed end of the housing. The spring assembly includes a series of elastomer pads arranged in axially stacked relation and contacting relation relative to each other. That is, in this form of the invention disclosure, the metal plates normally disposed between axially adjacent elastomer pads have been eliminated thus resulting in cost savings. Each elastomer pad of the spring assembly has generally flat and axially spaced and generally parallel first and second surfaces extending in generally normal relation relative to the longitudinal axis of the draft gear assembly. In this embodiment, the generally flat surfaces of two axially adjacent pads are arranged in direct contacting relation relative to each other. Preferably, each elastomer pad comprising the spring assembly has a durometer hardness ranging between about 40 and about 65 on a Shore D hardness scale.

The draft gear assembly further includes a spring seat arranged within the housing. The spring seat extends generally normal to the longitudinal axis of the draft gear and defines a generally flat surface arranged in contacting relation with the generally flat surface of the elastomer pad at a second end of the spring assembly. The spring contacting surface of the spring seat and the generally flat surface of the elastomer pad at the second end of the spring assembly define a first set of cooperating instrumentalities for aligning the spring seat and the spring assembly relative to the draft gear assembly longitudinal axis. Preferably, the spring seat has an indicator thereon for facilitating arrangement of the spring seat within the housing.

The first set of cooperating instrumentalities on the spring contacting surface of the spring seat and the generally flat surface on the elastomer pad at the second end of the spring assembly comprises projections disposed to opposite sides of the longitudinal axis of the draft gear assembly and extending from at least one of the spring contacting surface of the spring seat and the generally flat surface on the elastomer pad at the second end of the spring assembly and stops defined by the other one of the spring contacting surface of the spring seat and the generally flat surface on the elastomer pad at the second end of the spring assembly. The projections and stops are arranged in predetermined relation relative to each other to restrain movement of the elastomeric pad at the second end of the spring assembly relative to the spring seat. Moreover, and when the first cooperating instrumentalities engage with each other, the spring seat and adjacent elastomer pad are brought into and maintained in predetermined alignment relative to each other.

In one embodiment, the projections forming part of the first set of cooperating instrumentalities include two spaced projections depending from the spring contacting surface on the spring seat. The projections are preferably aligned relative to each other. The stops forming part of the first set of cooperating instrumentalities are preferably defined by two spaced recesses extending away from the generally flat surface of the elastomer pad at the second end of the spring assembly. The recesses are preferably aligned relative to each other. The spacing between the projections and recesses are generally equal.

Preferably, any two axially adjacent elastomer pads of the spring assembly define a second set of cooperating instrumentalities for effecting and maintaining general axial alignment of the pads relative to each other and relative to the longitudinal axis of the draft gear assembly. In one form, the second set of cooperating instrumentalities for effecting and maintaining general axial alignment of the pads relative to each other and relative to the longitudinal axis of the draft gear assembly comprises projections extending from one of the generally flat surfaces on each elastomer pad and a plurality of stops defined by the confronting generally flat surface on the adjacent elastomer pad. The projections and stops on any two axially adjacent elastomer pads are arranged in predetermined relation relative to each other to restrain movements of the elastomeric pads relative to each other. As such, and when the projections and stops engage relative to each other, the adjacent elastomer pads are brought onto and maintained in predetermined alignment relative to each other.

Preferably, the projections forming part of the second set of cooperating instrumentalities includes two spaced projections depending from one of the generally flat surfaces on each elastomer pad and which are preferably aligned relative to each other. The stops forming part of the second set of cooperating instrumentalities are defined by two spaced recesses extending away from the confronting generally flat surface on an adjacent elastomer pad and which are preferably aligned relative to each other. The spacing between the projections and recesses are generally equal.

In one form, the wedge of the draft gear assembly defines a throughbore opening to opposite ends of the wedge. When the wedge is arranged in operable combination with friction members of the draft gear assembly, the wedge and the throughbore defined by the wedge generally align with the draft gear assembly longitudinal axis. To facilitate further alignment of the spring seat relative to the draft gear assembly longitudinal axis, an axially elongated guide is operably associated with and extends generally normal to and away from the spring seat. The guide has an outer diameter generally equal to or smaller than an inner diameter of the throughbore defined by the wedge such that, when the spring seat and wedge are arranged in operable combination, the guide telescopically extends into and slides within the wedge whereby aligning the spring seat relative to the longitudinal axis of the draft gear assembly.

In another family of embodiments, there is provided a railroad freight car draft gear assembly including an axially elongated metallic housing having a closed end, an open end, a spring chamber, and a longitudinal axis extending between the ends of the housing. A friction clutch assembly is provided for absorbing axial impacts directed against the draft gear. The friction clutch assembly includes a plurality of radially spaced friction members. Each friction member has an outer surface angled relative to the longitudinal axis and arranged in sliding friction engagement with the open end of the housing. The friction clutch assembly further includes an actuator having a plurality of angled surfaces. One end of the actuator axially extends beyond the open end of the housing for receiving energy directed axially to the draft gear. Each angled surface on the actuator is arranged in sliding friction engagement with an inner surface on each friction member.

A multi-tiered spring assembly is centered within the spring chamber of the housing and includes a series of axially stacked individual units for absorbing, dissipating and returning energy imparted to the actuator during operation of the draft gear. A first end of the spring assembly is arranged in operable contacting relation with the closed end of the housing. The individual units of the spring assembly each include an elastomer pad having generally flat and axially spaced generally parallel first and second surfaces extending in generally normal relation relative to the longitudinal axis of the draft gear assembly. In this embodiment, there are no metal plates separating the elastomer pads of two axially adjacent and individual spring units. Instead, the generally flat surfaces of two axially adjacent pads are arranged in direct contacting relation relative to each other. Preferably, each elastomer pad comprising the spring assembly has a durometer hardness ranging between about 40 and about 65 on a Shore D hardness scale.

A spring seat is arranged within the housing and has a generally flat surface extending generally normal to the longitudinal axis of the draft gear assembly and arranged in contacting relation with the generally flat surface of the elastomer pad at a second end of the spring assembly. The generally flat spring contacting surface of the spring seat and the generally flat surface of the elastomer pad at the second end of the spring assembly define a first set of cooperating instrumentalities for aligning the spring seat and the spring assembly relative to the longitudinal axis of the draft gear assembly.

In this embodiment, a lengthwise portion of the housing includes two pairs of joined sidewalls extending generally from the closed end toward the open end of the housing so as to provide the spring chamber with a generally rectangular cross-sectional configuration. In this form, a peripheral edge of the spring seat has a generally rectangular configuration, in plan, such that the spring seat has a particular orientation when operably arranged within the housing. Moreover, the spring seat preferably has an indicator thereon for facilitating orientation of the spring seat assembly within the housing.

In one form, the first set of cooperating instrumentalities comprises projections arranged on opposite sides of the longitudinal axis of the draft gear assembly and extending from at least one of the spring contacting surface on the spring seat and the generally flat surface on the elastomer pad at the second end of the spring assembly and stops defined by the other one of the spring contacting surface of the spring seat and the generally flat surface on the elastomer pad at the second end of the spring assembly. The projections and stops are arranged in predetermined relation relative to each other and relative to the longitudinal axis of the draft gear assembly laterally to restrain longitudinal and lateral movement between the spring seat and the axially adjacent elastomer pad.

Preferably, the projections forming part of the first set of cooperating instrumentalities include two spaced projections depending from the spring contacting surface on the spring seat and which are preferably aligned relative to each other. In this form, the stops forming part of the first set of cooperating instrumentalities are defined by two spaced recesses extending away from the generally flat surface of the elastomer pad at the second end of the spring assembly and which are preferably aligned relative to each other. The spacing between the projections and recesses being generally equal.

In one embodiment, any two axially adjacent individual units of the spring assembly define a second set of cooperating instrumentalities for effecting and maintaining general axial alignment of the elastomer pads relative to each other. In one form, the second set of cooperating instrumentalities for effecting and maintaining general axial alignment of the elastomer pads relative to each other comprises projections depending from one of the generally flat surfaces on each elastomer pad and stops defined by the confronting generally flat surface on the axially adjacent elastomer pad. The projections and stops are arranged in predetermined relation relative to each other and relative to the longitudinal axis of the draft gear assembly to restrain movements between the confronting surfaces of the elastomer pads.

Preferably, the projections forming part of this second set of cooperating instrumentalities includes two spaced projections depending from the generally flat surface on each elastomer pad and which are preferably aligned relative to each other. Moreover, in this embodiment, the stops forming part of this second set of cooperating instrumentalities are preferably defined by two spaced recesses extending away from the confronting generally flat surface on the axially adjacent elastomer pad and which are preferably aligned relative to each other. The spacing between the projections and recesses being generally equal.

In a preferred form, the actuator of the friction clutch assembly defines a throughbore opening to opposite ends of the wedge. When the actuator is arranged in operable combination with the draft gear assembly, the actuator, and thereby the throughbore defined by the actuator, generally aligns with the longitudinal axis of the draft gear assembly. Preferably, the draft gear assembly further includes an axially elongated guide operably associated with the spring seat and extending generally normal to and away from the spring contacting surface of the spring seat. In this embodiment, the guide has an outer diameter generally equal to or smaller than an inner diameter of the throughbore defined by the actuator such that, when the spring seat and actuator are arranged in operable combination with the draft gear assembly, the guide extends telescopically into and axially slides within the throughbore in the wedge whereby aligning the spring seat relative to the longitudinal axis of the draft gear assembly.

According to another aspect of this invention disclosure there is provided a railroad freight car draft gear assembly including an axially elongated metallic housing having a closed end, an open end, and a spring chamber. The housing defines a longitudinal axis for the draft gear assembly. A friction clutch assembly is provided for absorbing axial impacts directed against the draft gear assembly. The friction clutch assembly includes a plurality of friction members. Each friction member has an outer surface angled relative to the longitudinal axis and arranged in sliding friction engagement with the open end of the housing. The friction clutch assembly further includes an actuator having a plurality of angled surfaces. One end of the actuator axially extends beyond the open end of the housing for receiving energy directed axially to draft gear assembly. Each angled surface on the actuator is arranged in sliding friction engagement with an inner surface on each friction member.

In this embodiment, a multi-tiered spring assembly is arranged within the spring chamber of the housing. The spring assembly includes a series of axially stacked individual units for absorbing, dissipating and returning energy imparted to the actuator during operation of the draft gear. A first end of the spring assembly is arranged in operable contacting relation with the closed end of the housing. The individual units of the spring assembly each include an elastomer pad having generally flat and axially spaced generally parallel first and second surfaces extending in generally normal relation relative to the longitudinal axis of the draft gear assembly. Preferably, each elastomer pad has a durometer hardness ranging between about 40 and about 65 on a Shore D hardness scale.

As in the other embodiments, and to reduce costs while increasing the capacity of the spring assembly design, metal plates have been removed from between any two axially adjacent elastomer pads forming the spring assembly. As such, the generally flat surfaces of two axially adjacent elastomer pads are arranged in direct contacting relation relative to each other. A spring seat is arranged within the housing and has a generally flat surface extending generally normal to the longitudinal axis of the draft gear assembly and is arranged in contacting relation with the generally flat surface of the elastomer pad at a second end of the spring assembly.

According to this aspect of the invention disclosure, an interior surface on a rear wall at the closed end of the housing and the generally flat surface of the elastomer pad at the first end of the spring assembly define therebetween cooperating instrumentalities for aligning the first end of the spring assembly relative to the draft gear assembly longitudinal axis. In one form, the cooperating instrumentalities for aligning the first end of the spring assembly relative to the longitudinal axis of the draft gear assembly includes projections extending from the generally flat surface on the elastomer pad at the first end of the spring assembly and stops defined by the interior surface on the rear wall at the closed end of the housing. The projections and stops are arranged in predetermined relation relative to each other and relative to the longitudinal axis of the draft gear assembly so as to inhibit the elastomer pad at the first end of the spring assembly from longitudinally and laterally shifting relative to the closed end of the housing and relative to the longitudinal axis of the draft gear assembly.

Preferably, the projections forming part of the cooperating instrumentalities for aligning the first end of the spring assembly relative to the draft gear assembly longitudinal axis includes two spaced apart projections disposed to opposed sides of the longitudinal axis of the draft gear assembly and depending from the generally flat surface on the elastomer pad at the first end of the spring assembly and which are aligned relative to each other. Preferably, the stops forming part of the cooperating instrumentalities for aligning the first end of the spring assembly relative to the draft gear assembly longitudinal axis includes two spaced recesses extending away from the interior surface on the rear wall at the closed end of the housing and which are aligned relative to each other. The spacing between the projections and recesses being generally equal.

In this embodiment, any two axially adjacent individual units of the spring assembly define another set of cooperating instrumentalities for effecting and maintaining general axial alignment of the elastomer pads relative to each other. Preferably, the other set of cooperating instrumentalities for effecting and maintaining general axial alignment of the elastomer pads relative to each other includes projections axially extending from one of the generally flat surfaces on each elastomer pad and stops defined by the confronting generally flat surface on the adjacent elastomer pad. The projections and stops on the pads are arranged in predetermined relation relative to each other and relative to the longitudinal axis of the draft gear assembly.

In one embodiment, the projections forming part of the other set of cooperating instrumentalities includes two spaced projections axially extending from the generally flat surface on each elastomer pad and which are aligned relative to each other. In this form, the stops forming part of the other set of cooperating instrumentalities are defined by two spaced recesses extending away from the confronting generally flat surface on the adjacent elastomer pad and which are aligned relative to each other. The spacing between the projections and recesses being generally equal.

According to yet another aspect of this invention disclosure, there is provided a railroad freight car draft gear assembly spring seat adapted to operably engage one end of a spring assembly in a railroad freight car draft gear. The spring seat includes a generally flat spring contacting surface with a generally rectangular marginal edge. The spring seat further includes free ended projections depending from the generally flat spring contacting surface on the spring seat. The projections on the spring seat are arranged in predetermined relation relative to each other and to opposed sides of a longitudinal axis of the draft gear assembly wherein the spring seat is to be operably arranged.

In one form, the projections on the spring seat each define camming surfaces thereon. Moreover, the projections on the spring seat preferably includes two spaced apart projections depending from the generally flat spring contacting surface on the spring seat and which are aligned relative to each other. To facilitate orientation of the spring seat within a housing of a draft gear, the spring seat has an indicator thereon. In one form, the railroad freight car draft gear assembly spring seat further includes an axially elongated guide operably associated with the spring seat and extending generally normal to and away from the generally flat spring contacting surface of the spring seat.

According to another aspect of this invention disclosure there is provided a railroad freight car draft gear assembly elastomer spring including an elastomer pad having a generally rectangular configuration in plan. The elastomer pad has spaced first and second generally flat faces and generally vertical wall sections joining the generally flat faces. The pad is formed from a copolyesther polymer elastomer having an elastic strain to plastic strain ratio of about 1.5 to 1 and has a Shore D hardness ranging between about 40 and about 65. The first generally flat face of the elastomer pad includes free ended projections depending therefrom and which are formed integral with the pad. The second generally flat face of the elastomer pad spring defines stops adapted to cooperate with the axial free ended projections on a like elastomer pad whereby facilitating orientation of the pads relative to each other while inhibiting movements between two axially adjacent pads. The projections and stops on the faces of the elastomer pad are arranged in predetermined relation relative to each other.

Preferably, the projections on the pad include two projections disposed to opposed sides of a longitudinal axis of a draft gear assembly wherein the pad is to be operably arranged. The projections depend from the first generally flat spring engaging surface on the elastomer pad and are aligned relative to each other. In a preferred form, the stops on the second face of the elastomer pad are defined by two spaced recesses extending away from second generally flat spring engaging surface on the elastomer pad and which are aligned relative to each other. The spacing between the projections and recesses are generally equal.

DETAILED DESCRIPTION

Figure 1:
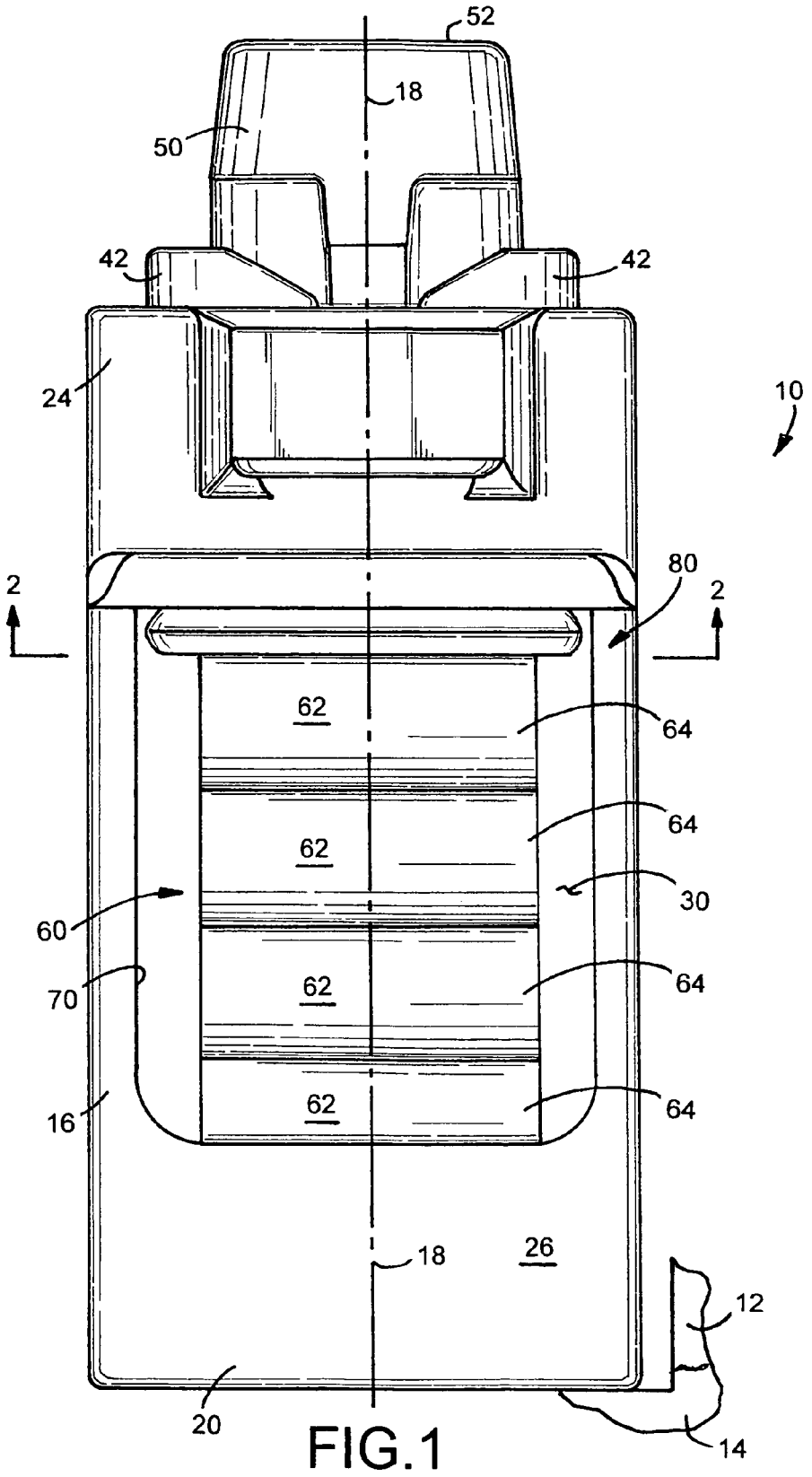
FIG. 1 is an elevational view of one form of railcar draft gear embodying principals and teachings of the present invention disclosure.

While this invention disclosure is susceptible of embodiment in multiple forms, there is shown in the drawings and will hereinafter be described a preferred embodiment, with the understanding the present disclosure sets forth exemplifications of the disclosure which are not intended to limit the disclosure to the specific embodiment illustrated and described.

Referring now to the drawings, wherein like reference numerals indicate like parts throughout the several views, there is shown in FIG. 1 a railroad car draft gear assembly, generally indicated by reference numeral 10, adapted to be carried within a yoke 12 arranged in operable combination with a centersill (not shown) of a railcar 14. Draft gear assembly 10 includes an axially elongated hollow and metallic housing 16 defining a longitudinal axis 18 for the draft gear assembly 10. Housing 16 has a first or closed end 20 having a rear or end wall 22 (FIG. 3) and is open toward an axially aligned second or open end 24.

The particular size and shape of housing 16 is not particularly relevant to this invention disclosure and it should be understood the illustrated housing is but one of any of a series of shapes and sizes to which this invention disclosure finds utility. In the embodiment illustrated for exemplary purposes in FIG. 2, housing 16 includes two pairs of joined and generally parallel walls 26, 26' and 28, 28', extending from the closed end 22 toward the open end 24 (FIG. 1), and defines a hollow spring chamber 30 (FIGS. 1 and 3). In the example illustrated in FIG. 2, the walls 26, 26' and 28, 28' provide the spring chamber 30 with a generally rectangular or box-like cross-sectional configuration for a major lengthwise portion thereof.

Figure 3:
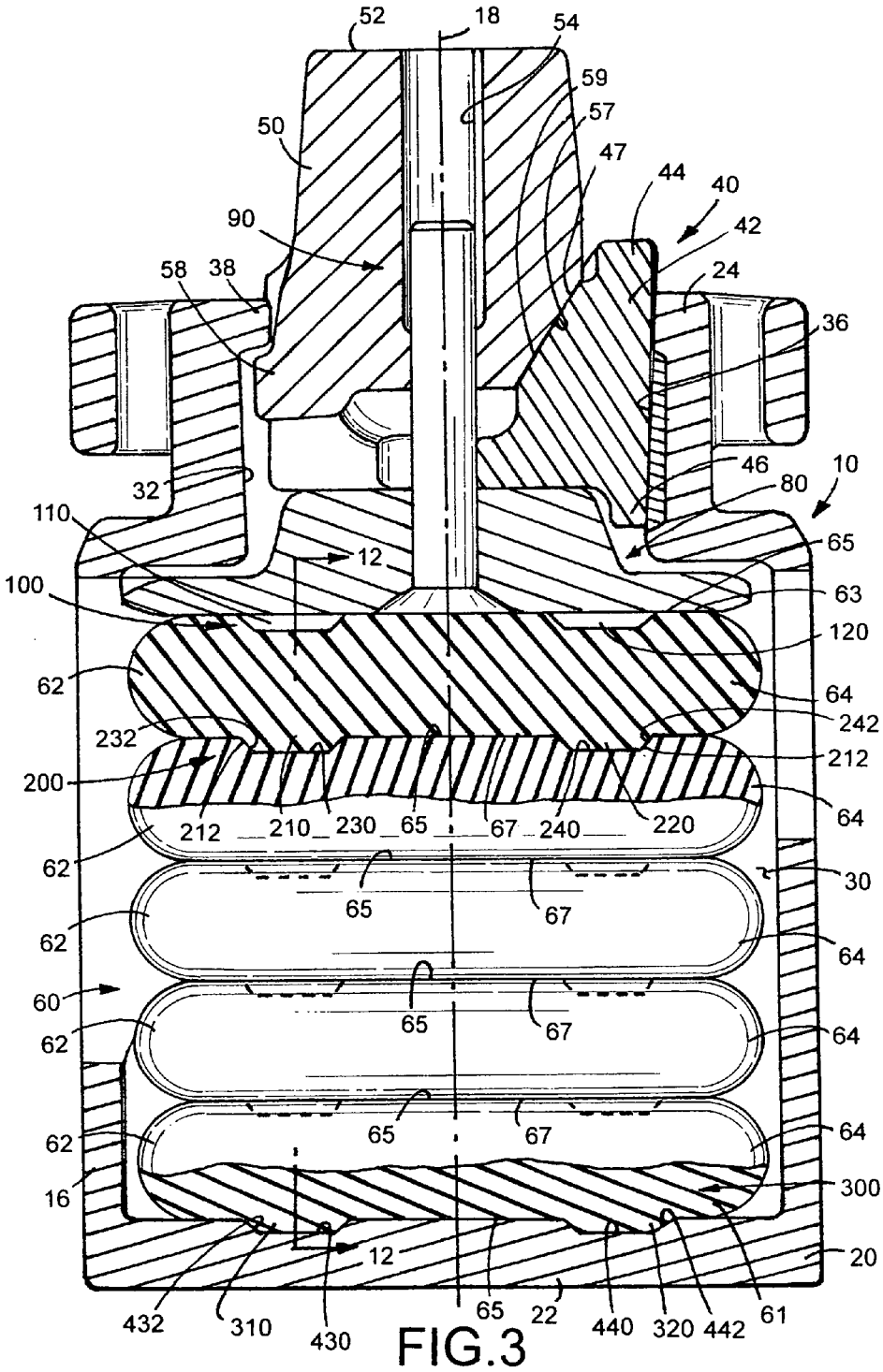
FIG. 3 is a longitudinal sectional view of the draft gear illustrated in FIG. 1.
Figure 4:
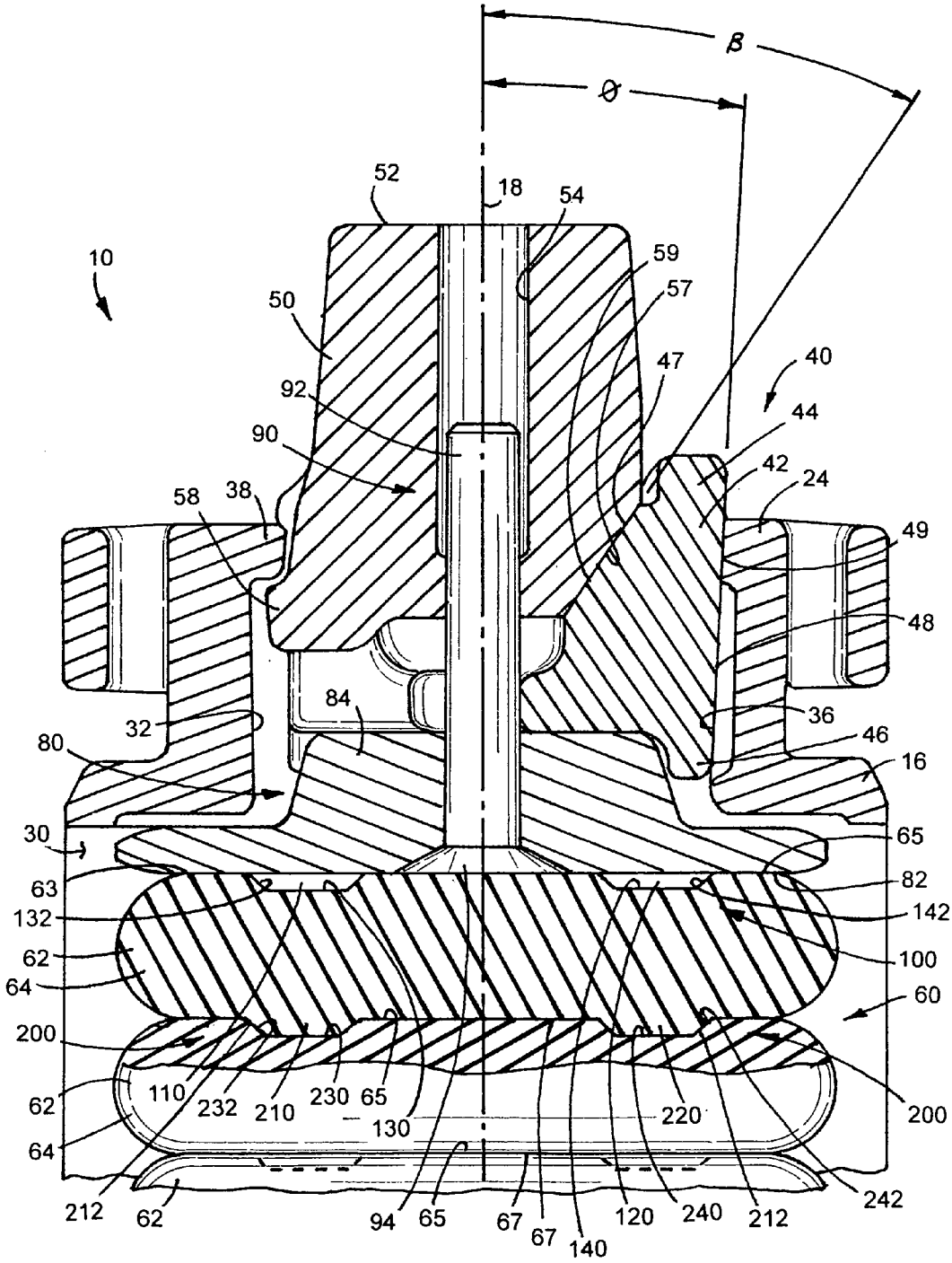
FIG. 4 is an enlarged sectional view of one end of the draft gear illustrated in FIG. 3.

As shown in FIGS. 3 and 4, the draft gear housing 16 has a friction bore 32 which opens to spring chamber 30 and to end 24 of the draft gear housing 16. Moreover, and as shown in FIG. 3, the internal friction bore 32 is provided with a plurality (with only one being shown in FIGS. 3 and 4) of equi-angularly spaced and longitudinally extended tapered inner angled friction surfaces 36. The tapered inner angled friction surfaces 36 on housing 16 converge toward the longitudinal axis 18 and toward the closed end 20 of the draft gear housing 16. Preferably, housing 16 is provided with three equally spaced longitudinally extended and tapered inner angled friction surfaces 36 but more tapered surfaces could be provided without detracting or departing from the spirit and novel concept of this invention disclosure.

In the embodiment shown in FIG. 3, and toward the open end 24 of housing 16, draft gear assembly 10 is provided with a friction clutch assembly 40 for absorbing draft forces or impacts axially directed against the draft gear 10. In the embodiment shown in FIG. 3, the friction clutch assembly 40 includes a plurality of friction members or shoes 42 arranged about axis 18 and in operable combination with the tapered inner angled friction surfaces 36 at the open end of the draft gear housing 16. In the illustrated embodiment, the friction clutch assembly 40 includes three equi-angularly spaced friction members 42 but more friction members could be provided without detracting or departing from the spirit and novel concept of this invention disclosure. In the embodiment shown by way of example in FIGS. 3 and 4, the number of friction members 42 forming part of the friction clutch assembly 40 are equal in number to the number of tapered inner angled friction surfaces 36 on housing 16.

Turning to FIG. 4, each friction member 42 has axially or longitudinally spaced first and second end 44 and 46, respectively. Moreover, each friction member 42 has an outer or external tapered sliding surface 48. When the draft gear 10 is assembled, each inner angled friction surface 36 on housing 16 combines with each outer tapered sliding surface 48 on each friction member to define a first angled friction sliding surface 49 therebetween. The first friction sliding surface 49 is disposed at an angle θ relative to the longitudinal axis 18 of the draft ger assembly 10. As will be appreciated by a person of ordinary skill in the art, the angle θ relative to the longitudinal axis 18 of the draft gear assembly 10 will be determined upon the particular force/travel curve performance desired for the draft gear assembly 10.

In the illustrated embodiment, the friction clutch assembly 40 further includes a wedge or actuator 50 arranged for axial movement relative to the open end 24 of housing 16. As shown in FIGS. 1, 3 and 4, an outer end 52 of the wedge 50 preferably has a generally flat face that extends beyond the open end 24 of housing 16 and is adapted to bear on the usual follower (not shown) of a railway draft rigging such that draft or impact forces can be axially applied to the draft gear assembly 10 during operation of the railcar 14. As known, wedge 50 is arranged in operable combination with and is generally centered relative to the longitudinal axis 18 of draft gear assembly 10 by the friction members 42.

Turning again to FIG. 4, the wedge 50 defines a plurality of outer tapered or angled friction surfaces 57 arranged in operable combination with the friction members 42 of the clutch assembly 40. Although only one friction surface 57 is shown in FIGS. 3 and 4, the number of friction surfaces 57 on wedge member 50 equals the number of friction members 42 used as part of the friction clutch assembly 40. When the draft gear assembly 10 is assembled, each outer angled friction surface 57 on wedge 50 combines with an inner angled sliding surface 47 on each friction member 42 to define a second angled friction sliding surface 59 therebetween. The friction sliding surface 59 is disposed at an angle β relative to the longitudinal axis 18 of draft gear 10. As will be appreciated by a person of ordinary skill in the art, the angle β relative to the longitudinal axis 18 of the draft gear assembly 10 will be determined depending upon the particular force/travel curve performance desired for the draft gear assembly 10.

Wedge 50 is formed from any suitable metallic material. In a preferred form, wedge member 50 is formed from an austempered ductile iron material. Moreover, and as shown in FIGS. 3 and 4, the wedge member or actuator 50 defines a generally centralized longitudinally extending bore 54 which opens to opposed ends of wedge 50.

As shown in FIGS. 3 and 4, at its open end 24, housing 16 is provided with a series of radially inturned stop lugs 38 which are equi-angularly spaced circumferentially relative to each other. Toward a rear or inner end thereof, wedge 50 includes a series of radially outwardly projecting lugs 58 which are equi-angularly disposed relative to each other and extend between adjacent friction members 42 so as to operably engage in back of the lugs 38 on housing 16 and facilitate assembly of the draft gear assembly 10.

An axially elongated spring assembly 60 is generally centered within spring chamber 30 of the draft gear housing 16 and forms a resilient column for storing dissipating and returning energy imparted or applied to the free end 52 of wedge 50 during axial compression of the draft gear assembly 10. As known, spring assembly 60 is precompressed during assembly of the draft gear assembly 10 and serves to maintain the components of the friction clutch assembly 40, including friction members 42 and wedge 50, in operable combination relative to each other and within the draft gear housing 16. In the illustrated embodiment, spring assembly 60 develops a preload force for the draft gear assembly 10 and, in combination with the spring assembly 40, is capable of absorbing, dissipating and returning impacts or energy directed axially thereto in the range of between 450,000 lbs. and about 700,000 lbs.

Spring assembly 60 can take a myriad of shapes and sizes from that shown for exemplary purposes. In the form shown in FIG. 3, spring assembly 60 has a first end 61 which engages with the rear wall 22 at the closed end 20 of the draft gear housing 16 and a second end 63 arranged in axially spaced relation from the spring assembly first end 61. In the embodiment illustrated by way of example in FIGS. 1 and 3, spring assembly 60 is comprised of a multi-tired structure including a plurality of individual units or springs 62 arranged in axially stacked relationship relative to each other.

Figure 5:
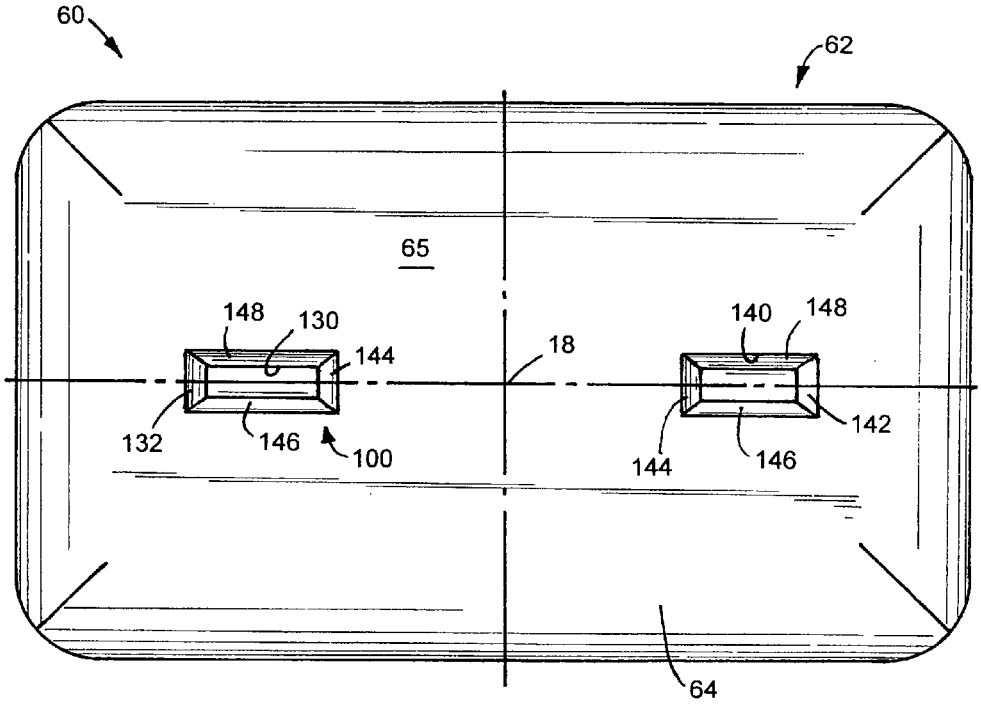
FIG. 5 is a top plan view of an elastomeric spring unit embodying principals and teachings of this invention disclosure and forming part of a spring assembly.
Figure 6:
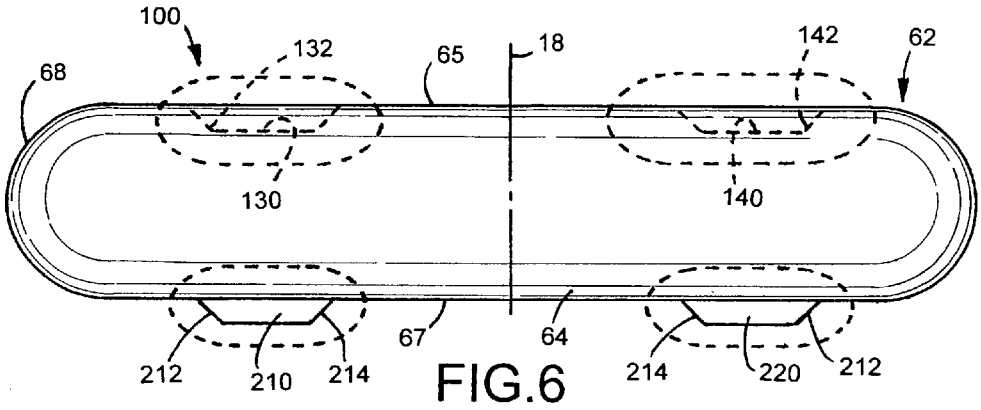
FIG. 6 is an elevational view of the spring unit illustrated in FIG. 5.
Figure 7:
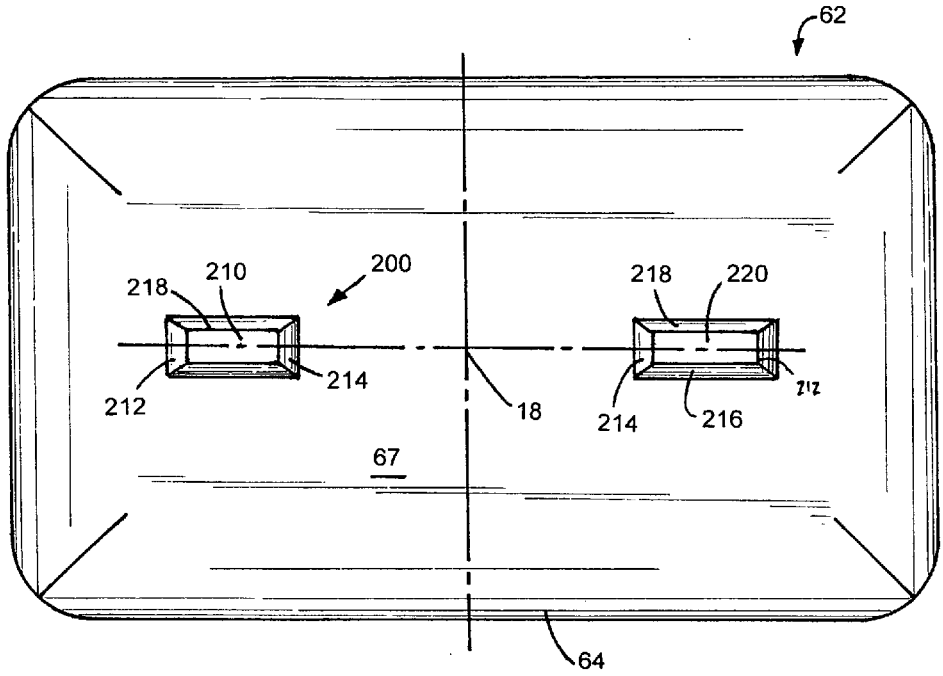
FIG. 7 is a bottom plan view of the elastomeric spring unit shown in FIG. 5.

Each cushioning unit or spring 62 preferably includes an elastomer pad 64 having a generally rectangular shape (FIGS. 5 and 7), in plan, so as to optimize the rectangular area of the spring chamber 30 (FIG. 3) wherein spring assembly 60 is arranged for axial endwise movements in response to loads or impacts being exerted axially against the draft gear 10. Preferably, each pad 64 has a Shore D hardness ranging between about 40 and about 60. In the form shown in FIGS. 3 and 6, each pad 64 has first and second generally flat surfaces 65 and 67 with a generally vertical wall 68 extending therebetween and joining the generally flat surfaces 65 and 67. To reduce costs while increasing the capacity of the spring assembly design, metal plates normally disposed between any two axially adjacent pads have been removed. As such, and as shown in FIG. 3, the generally flat confronting faces 65 and 67 of any two axially adjacent pads 64 comprising spring assembly 60 are arranged in direct contacting relation relative to each other.

The thermoplastic elastomer pad 64 can be formed from a myriad of elastomeric materials. Preferably, the thermoplastic pad 64 is formed from a copolyesther polymer elastomer of the type manufactured and sold by the DuPont Company under the tradename HYTREL™. A HYTREL™ elastomer has inherent physical properties making it unsuitable for use as a spring. Applicants' assignee has advantageously discovered it is possible to impart spring-like characteristics to a HYTREL™ elastomer. Co-assigned U.S. Pat. No. 4,198,037 to D. G. Anderson patent better describes the above noted polymer material and forming process. The applicable portions of U.S. Pat. No. 4,198,037 are incorporated herein by reference. Suffice it to say, each pad 64 is preferably formed from the above-described thermoplastic material and has a plastic strain to elastic strain ratio greater than 1.5 to 1.

Figure 2:
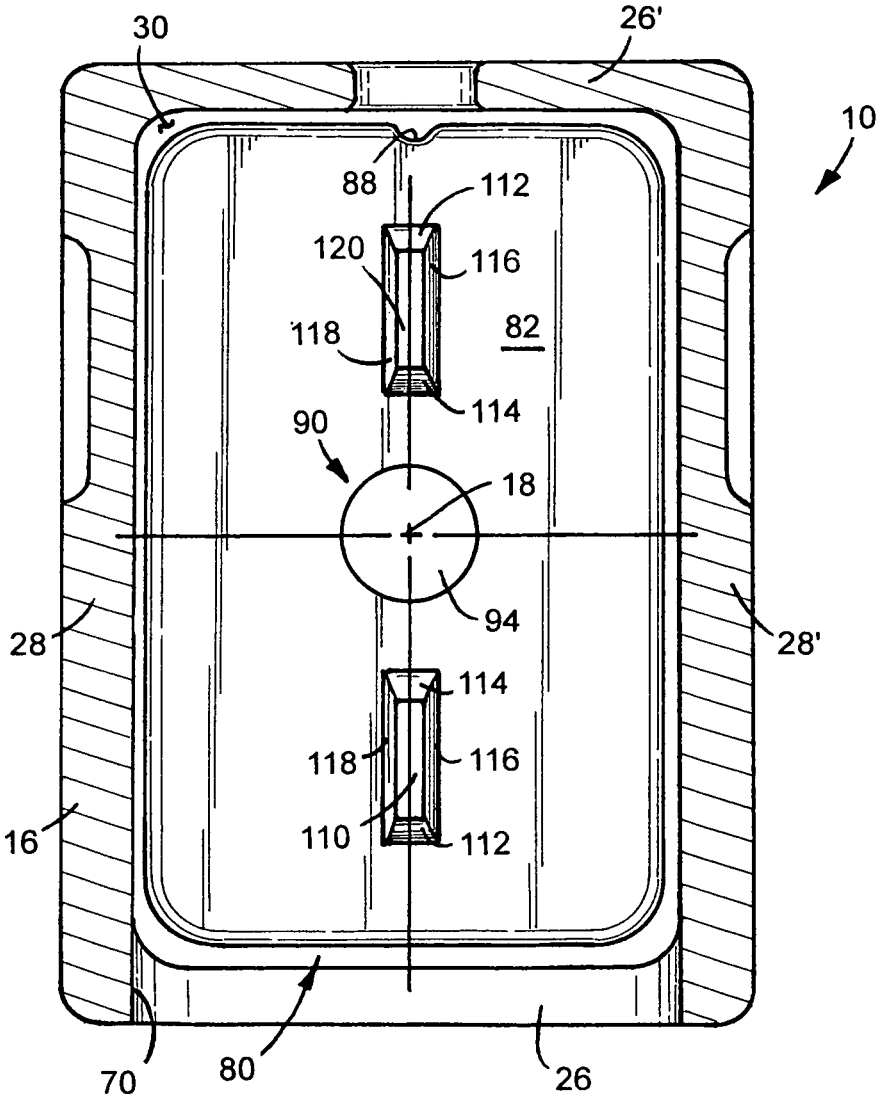
FIG. 2 is a sectional view taken along line 2-2 of FIG. 1.

As shown in FIGS. 1 and 2, a relatively large rectangular opening 70 is preferably formed in wall 26 of the draft gear housing 16. Opening 70 is sized such that one or more of the spring units 62 can be inserted through the opening 70 in a direction extending generally normal to the longitudinal axis 18 of the draft gear and into the hollow spring chamber 30 of housing 16.

The draft gear assembly 10 furthermore includes a spring seat or follower 80 arranged within the draft gear housing 16 and operably disposed between spring assembly 60 and a lower end 44 of each friction member or shoe 42 of the friction clutch assembly 40. As shown in FIGS. 3 and 4, and when the spring seat 80 is operably arranged within the spring chamber 30 of the draft gear housing 16, the spring seat 80 extends generally normal or perpendicular to the longitudinal axis 18 of the draft gear 10.

Figure 8:
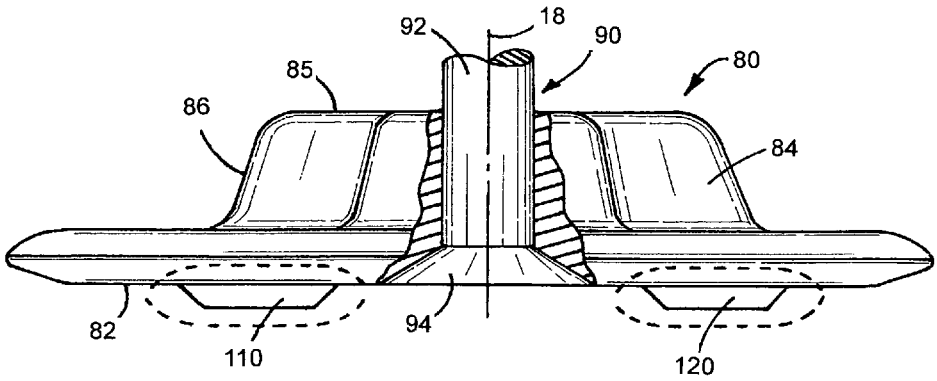
FIG. 8 is an enlarged elevational view of one form of spring seat embodying principals and teachings of this invention disclosure shown in disassembled relation from the draft gear illustrated in FIGS. 1 through 4.
Figure 9:
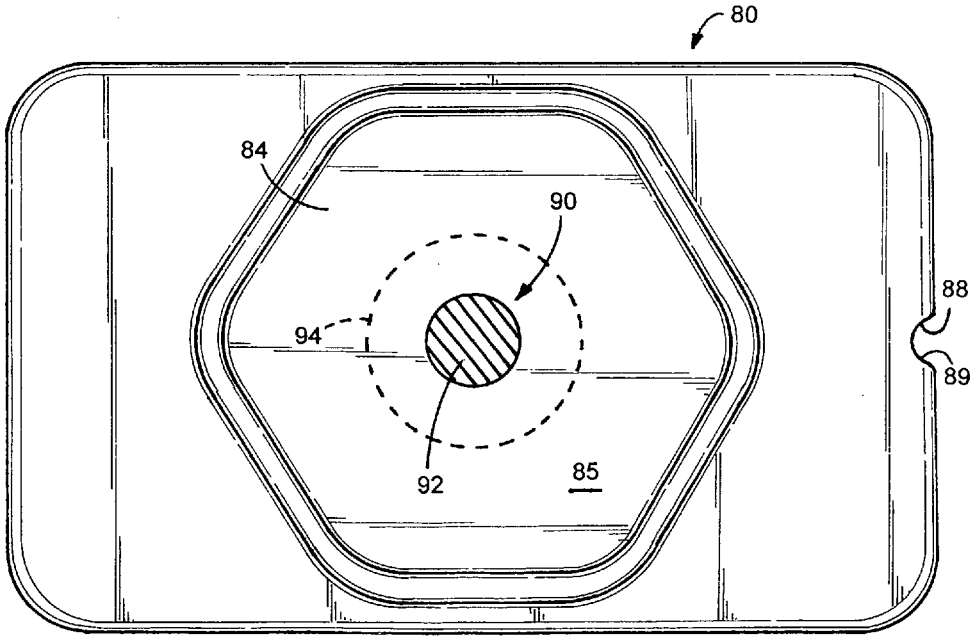
FIG. 9 is a top plan view of the spring seat shown in FIG. 8.

As shown in FIGS. 4 and 8, the spring seat 80 preferably has a generally planar spring engaging or contacting surface 82 which, when the spring seat 80 is arranged in operable relation with the draft gear assembly 10 (FIG. 4), is arranged in contiguous or contacting relation relative to the second end 63 of the spring assembly 60. In the embodiment illustrated in FIGS. 2 and 9, a portion of spring seat 80 has a generally rectangular configuration, in plan, so as to fit within the spring chamber 30 of the draft gear assembly 10.

In the embodiment illustrated by way of example in FIG. 8, and on that side opposite from spring contacting surface 82, the spring seat 80 preferably includes an upstanding projection 84 generally centrally disposed on the spring seat 80 and which, when the spring seat 80 is arranged in operable relation relative to the draft gear assembly 10, at least partially extends into the friction bore 32 of draft gear housing 16 (FIG. 4). An upper face or end 85 of the projection 84 is generally planar and extends generally parallel to the spring engaging or contacting surface 82 to slidably support each friction shoe or member 42. To facilitate operation of draft gear assembly 10 (FIG. 1), and as shown in FIG. 8, the projection 84 on spring seat 80 has an outer chamfer or angled edge 86 depending from the planar surface 85 and extending, at least partially, about projection 84.

Spring seat 80 is formed from any suitable metallic material. In a preferred form, spring seat 80 is formed from an austempered ductile iron material. During the operation of the draft gear assembly 10, and besides moving vertically within the friction bore 32 of the draft gear housing 16, the friction shoes or members 42 likewise move radially inwardly and outwardly relative to the longitudinal axis 18 of the draft gear 10. Forming spring seat 80 preferably from the austempered ductile iron adds lubricity of the contacting surface engagement between the friction members or shoes 42 and the upper supporting surface 85 of the spring seat 80.

Spring seat 80 furthermore preferably includes an indicator 88 (FIGS. 2 and 9) for facilitating arrangement of the spring seat 80 within spring chamber 30 of draft gear housing 16. The indicator 88 can take any of a myriad of designs without detracting or departing from the present invention disclosure. In the embodiment illustrated by way of example, however, indicator 88 is in the form of an open ended notch or groove 89 provided on a peripheral edge of the spring seat 80 whereby indicating the preferred direction of insertion for the spring seat 80 relative to the friction members 42 of the friction clutch assembly 40.

As shown in FIG. 8, and for purposes described below, an axially elongated guide 90 is operably associated with and extends generally normal to and away from the spring contacting surface 82 of the spring seat 80. Guide 90 preferably includes an axially elongated shank portion 92 having a generally cylindrical-like configuration extending through and guided by the spring seat 80 and a head portion 94. The shank portion 92 of guide 90 has an outer diameter generally equal to or slightly smaller than the inside diameter of the throughbore 54 (FIG. 4) in the wedge or actuator 50 such that when the spring seat 80 and actuator 50 are arranged in operable combination relative to each other and during operation of the draft gear assembly 10, guide 90 is telescopically and slidably guided within the throughbore 54 of actuator 50 whereby effectively aligning the guide 90 with the longitudinal axis 18 of the draft gear assembly 20.

In the embodiment illustrated in FIG. 8, the head portion 94 of guide 90 has a radially enlarged configuration relative to the shank portion 92 and is operably associated with the spring seat 80. In the illustrated embodiment, the enlarged head portion 94 of guide 90 is configured to coact with the spring seat 80 such that when the spring seat 80 and actuator 50 are arranged in operable combination relative to each other and during operation of the draft gear assembly 10, guide 90 serves to axially align spring seat 80 with the longitudinal axis 18 of the draft gear assembly 10.

In accordance with one aspect of the present invention disclosure, and to improve operating performance of the draft gear assembly 10, there is provided a first set of cooperating instrumentalities, generally indicated in the drawings by reference numeral 100, for effecting axial alignment of the spring seat 80 and the spring assembly 60 relative to the longitudinal axis 18 of the draft gear assembly 10. The first set of cooperating instrumentalities 100 furthermore serve to restrain lateral and longitudinal shifting movements of the spring assembly 60 relative to the spring seat 80. The first set of cooperating instrumentalities 100 for aligning the spring seat 80 and the spring assembly 60 relative to the longitudinal axis 18 of the draft gear assembly 10 are defined by the elastomer pad 64 at the second end 63 of the spring assembly 60 and the spring seat 80.

In the illustrated embodiment, the cooperating instrumentalities 100 include a plurality of projections 110 and 120 (FIG. 4) axially extending from at least one of the spring contacting surface 82 of the spring seat 80 and a plurality of stops 132 and 142 (FIG. 4) defined by confronting surface 65 of the pad 64 at the second end of the spring assembly 60. The projections 110, 120 and stops 132, 142 are arranged in predetermined relation relative to each other and relative to axis 18 of the draft gear assembly 10. As such, and when spring seat 80 and the elastomer pad 64 at the second end 63 of the spring assembly are arranged in operable combination relative to each other, the projections 110, 120 and stops 132, 142 engage and interlock in predetermined alignment relative to each other and relative to the axis 18 of the draft gear assembly 10 whereby restraining movements between the elastomer pad 64 at the second end of the spring assembly 60 and the spring seat 80.

Figure 10:
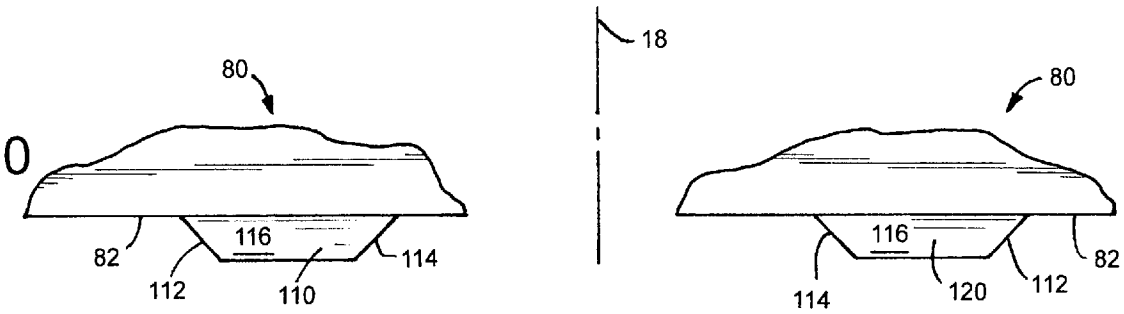
FIG. 10 is a fragmentary elevational view of those areas of the spring seat encircled by phantom lines in FIG. 5.

In the preferred form shown in FIGS. 8 and 10, the projections 110, 120 forming part of the first set of cooperating instrumentalities 100 include two projections axially extending from the spring contacting face 82 of the spring seat 80. To optimize their effect, the projections 110, 120 are disposed to opposed sides of the draft gear assembly longitudinal axis 18. Preferably, and as shown in FIG. 11, the projections 110, 120 are substantially similar and are axially aligned relative to each other generally along a longitudinal axis 85 of the spring seat 80.

Figure 11:
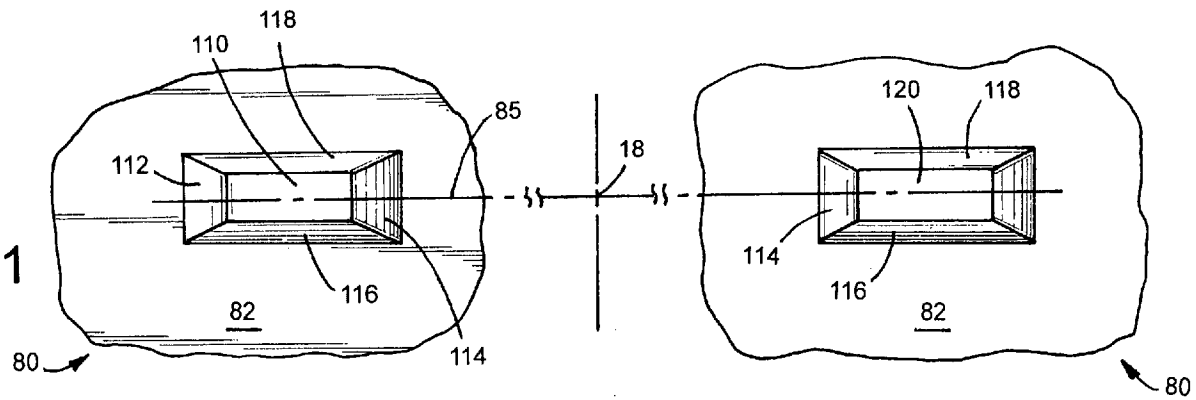
FIG. 11 is a fragmentary bottom plan view of those elements shown in FIG. 10
Figure 13:
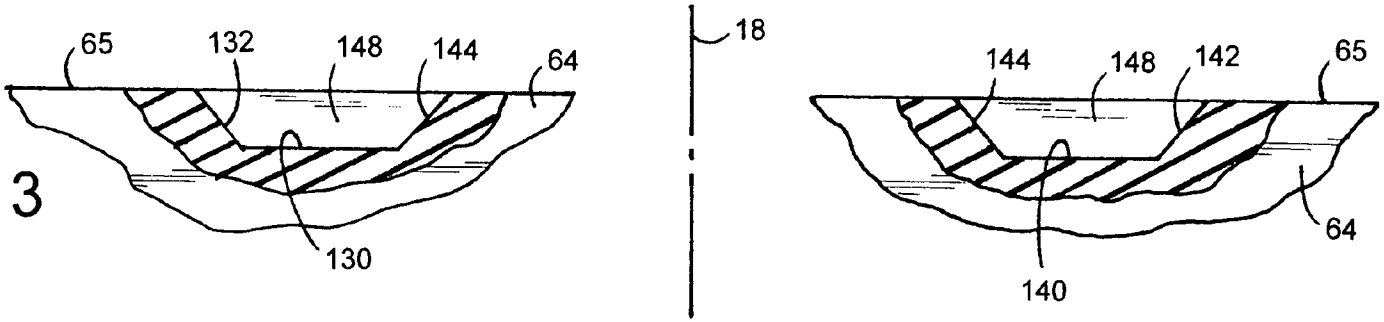
FIG. 13 is a fragmentary sectional view of those areas of the spring unit encircled by phantom lines in FIG. 8.

As illustrated by way of example in FIGS. 10 and 11, each projection 110, 120 on the spring seat 80 has an elongated generally rectangular configuration although other configurations, i.e. square, cylindrical, or triangular, etc. would equally suffice without detracting or departing from the spirt and scope of this invention disclosure. Preferably, each projection 110 axially extends away from the generally flat spring engaging surface 82 of spring seat 80 for a distance ranging between about 7 mm. to about 12 mm. In a most preferred form, each projection 110,120 axially extends away from the generally flat spring engaging surface 82 of spring seat 80 for a distance of about 10 mm. In one form, each projection 110 has a length ranging between about 35 mm. to about 45 mm. In a most preferred form, each projection has length of about 40 mm. Moreover, each projection 110 has a width ranging between about 15 mm. to about 25 mm. In a most preferred form, each projection has a width of about 20 mm.

As shown in FIG. 11, and based on its generally rectangular configuration, the projections 110, 120 on spring seat 80 each preferably includes a series of angled surfaces 112, 114, 116 and 118 extending between a distal or free end of the projection and the generally flat spring contacting surface 82 of the spring seat 80. The camming surfaces 112 are provided toward the lateral outermost end of each projection 110, 120 while camming surfaces 114 are provided toward a laterally inward end of each projection 110, 120. As shown in FIG. 10, the camming surfaces 112 on the lateral outermost end of each projection 110, 120 slant or are angled in opposed directions relative to each other. Moreover, a predetermined distance separates the camming surfaces 112 on the projections 110, 120. Preferably, the camming surfaces 112 and 114 extend from a distal end of each projection 110, 120 toward the generally flat surface 82 of the spring seat 80 at an angle of about 45 degrees relative to a vertical plane extending generally normal to the generally flat spring engaging surface 82 on the spring seat 80.

Figure 12:
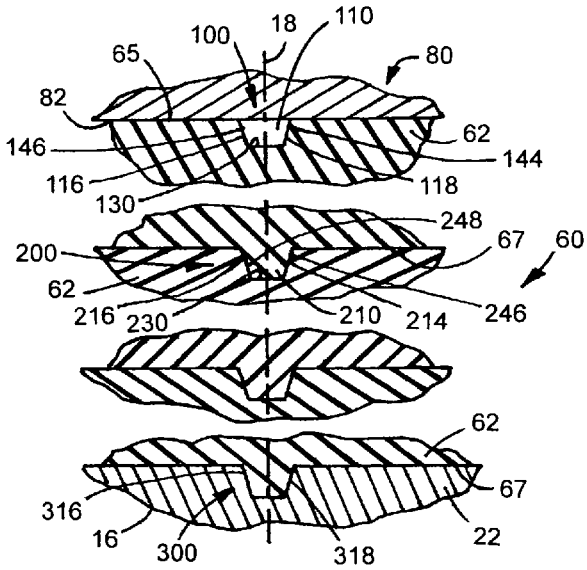
FIG. 12 is a fragmentary sectional view taken along line 12-12 of FIG. 3.

As shown in FIGS. 11 and 12, the camming surfaces 116 and 118 are preferably disposed to opposed sides of each projection 110, 120 on spring seat 80. In one form, the camming surfaces 116, 118 each extend from a distal end of each projection 110, 120 and toward the generally flat surface 82 of the spring seat 80 at an angle ranging between about 6 degrees and about 10 degrees relative to a vertical plane extending generally normal to the generally flat spring engaging surface 82 on the spring seat 80. In a preferred form, surfaces 116, 118 each extend from a distal end of each projection 110, 120 and toward the generally flat surface 82 of the spring seat 80 at an angle ranging between about 7 degrees relative to a vertical plane extending generally normal to the generally flat spring engaging surface 82 on the spring seat 80.

Returning to FIGS. 5 and 6, the stops 132, 142 forming part of the first cooperating instrumentalities 100 are provided on the pad 64 at the second end 63 of the spring assembly 60 (FIGS. 3 and 4) and are, as mentioned above, arranged in predetermined relation relative to the projections 110 and 120, respectively, (FIG. 4) and relative to the longitudinal axis 18 of the draft gear assembly 10 (FIG. 4). As shown in FIG. 4, the stops 132, 142 are arranged to opposed sides of the longitudinal axis 18 of the draft gear assembly 10 and are designed to engage, mate and positively interlock with the projections 110, 120, respectively, on spring seat 80 during assembly and operation of draft gear assembly 10.

In the embodiment illustrated in FIGS. 5, 6, 13 and 14, the stops 132 and 142 are defined by a pair of recesses 130 and 140 provided on face 65 of the elastomer pad 64 at the second end 63 of the spring assembly 60 (FIG. 4). In the embodiment shown by way of example, the stops 132, 142 on pad 64 are spaced apart from each other by the same predetermined distance separating the camming surfaces 112 provided toward the lateral outermost end of each projection 110, 120, respectively (FIGS. 4, 10 and 11). In one form, the recesses 130 and 140 are provided in the face 65 of spring pad 64 during formation of the spring unit 62 thereby ensuring accuracy and consistency between pads 64.

In the embodiment illustrated in FIG. 4, the recesses 130, 140 axially extend away from the generally flat surface 65 on pad 64 and are arranged in predetermined relation relative to the projections 110, 120, respectively, on spring seat 80, to each other and relative to the longitudinal axis 18 of the draft gear assembly 10 (FIG. 4). In the preferred form shown in FIGS. 5, 13 and 14, the recesses 130, 140 are substantially mirror images of the respective spring seat projection 110, 120 (FIG. 4) to be accommodated therewithin; with one recess 130, 140 being disposed to each side of the longitudinal axis 18 of the draft gear assembly. As illustrated by way of example in FIGS. 13 and 14, each recess 130, 140 on the spring seat 80 has an elongated generally rectangular configuration. Of course, if the projections 110, 120 (FIG. 4) would have other configurations, i.e. square, cylindrical, or triangular, etc., the configuration of each recess 130, 140 would also change to be generally reflective thereof.

Preferably, each recess 130, 140 axially extends away from the generally flat spring surface 65 for a distance ranging between about 7 mm. to about 12 mm. In a most preferred form, each recess 130,140 axially extends away from the generally flat spring surface 65 for a distance of about 10 mm. In one form, each recess 130, 140 has a length ranging between about 35 mm. to about 45 mm. In a most preferred form, each recess 130, 140 has length of about 40 mm. Moreover, each recess 130, 140 has a width ranging between about 15 mm. to about 25 mm. In a most preferred form, each recess 130, 140 has a width of about 20 mm.

Figure 14:
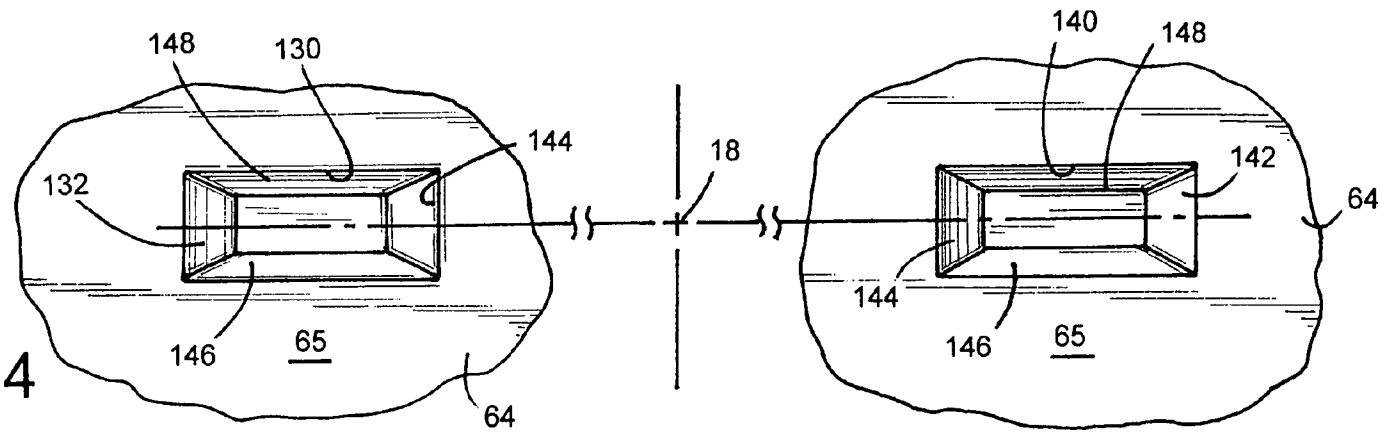
FIG. 14 is a fragmentary top plan view of those areas illustrated in FIG. 13.

As shown in FIG. 14, and besides defining stops 132, 142, respectively, each recess 130, 140 on pad 64 preferably includes a series of camming surfaces 144, 146 and 148 extending from the generally flat surface 65 of the spring pad 64 for facilitating correct positioning of the spring pad 64 at the second end 63 of the spring assembly and relative to the spring seat 80 during operable assembly of the draft gear assembly 10. In the embodiment illustrated in FIG. 13, the stops 132, 142 are each slanted at an angle relative to the generally flat surface 67 of the spring pad 64 which is complimentary to the angle of the outermost edges 112 of each projection 110, 120. Similarly, the other camming surfaces 144, 146 and 148 on each recess 130, 140 generally compliment the surfaces 114, 116 and 118 provided on each spring seat projection 110, 120.

Upon operable assembly of the spring assembly 60 and spring seat 80 into the draft gear housing 16, the projections 110, 120 on spring seat 80 extend into the recesses 130, 140, respectively, defined by the upper and confronting generally flat surface 65 on the axially adjacent pad 64 such that the stopping surfaces 112 on the projections 110, 120 operably engage and interlock with the stops 132, 142, respectively, on the adjacent pad 64 whereby restraining longitudinal movement therebetween while maintaining at least the upper end of the spring assembly 60 and spring seat 80 in predetermined alignment relative to each other and relative to the longitudinal axis 18 of the draft gear assembly 10. Moreover, and upon operable assembly of the spring assembly 60 and spring seat 80 into the draft gear housing 16, the projections 110, 120 on the spring seat 80 extend into the recesses 130, 140, respectively, defined by the upper generally flat surface 65 on the axially adjacent elastomeric pad 64 such that the surfaces 116 and 118 on the projections 110, 120 engage and interlock with the surfaces 146 and 148 defined by the recesses 130 and 140, respectively, on the axially adjacent elastomeric pad 64 whereby restraining lateral movement therebetween while maintaining at least the upper end of the spring assembly 60 and spring seat 80 in predetermined alignment relative to each other and relative to the longitudinal axis 18 of the draft gear assembly 10.

Returning to FIGS. 3 and 4, in accordance with another aspect of the present invention disclosure, and to improve operating performance of the draft gear assembly 10, there is provided a second set of cooperating instrumentalities, generally indicated in the drawings by reference numeral 200, preferably disposed between any two axially adjacent elastomer pads 64 arranged between the ends 61 and 63 of the spring assembly 60 for effecting axial alignment of the spring assembly 60 relative to the longitudinal axis 18 of the draft gear assembly 10. The second set of cooperating instrumentalities 200 furthermore serves to restrain shifting movements of the elastomeric spring units 64 relative to each other. In one form, the second set of cooperating instrumentalities 200 for effecting axial alignment of the spring assembly 60 relative to the longitudinal axis 18 of the draft gear assembly 10 are defined by and between the confronting faces 65 and 67 of any two axially adjacent elastomer pads 64 of spring assembly 60.

In one form, the second set of cooperating instrumentalities 200 includes a plurality of projections 210 and 220 (FIGS. 4, 15 and 16) axially extending from the generally flat surface 67 of spring pad 64 and a plurality of stops 232 and 242 (FIGS. 17 and 18) provided on face 65 of an axially adjacent elastomer pad 64. The projections 210, 220 and stops 232, 242 are arranged in predetermined relation relative to each other and relative to the longitudinal axis 18 of draft gear assembly 10.

Figure 15:
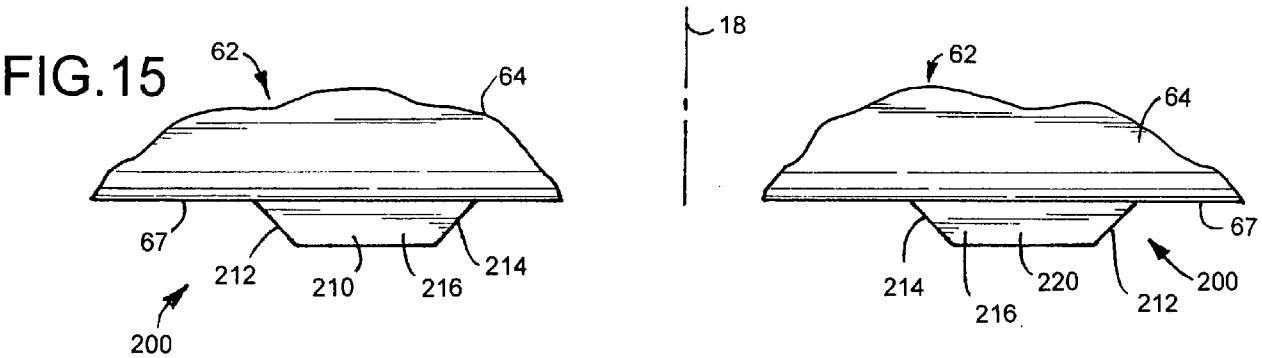
FIG. 15 is a fragmentary elevational view of those areas of the spring unit encircled by dash lines in FIG. 8.
Figure 16:
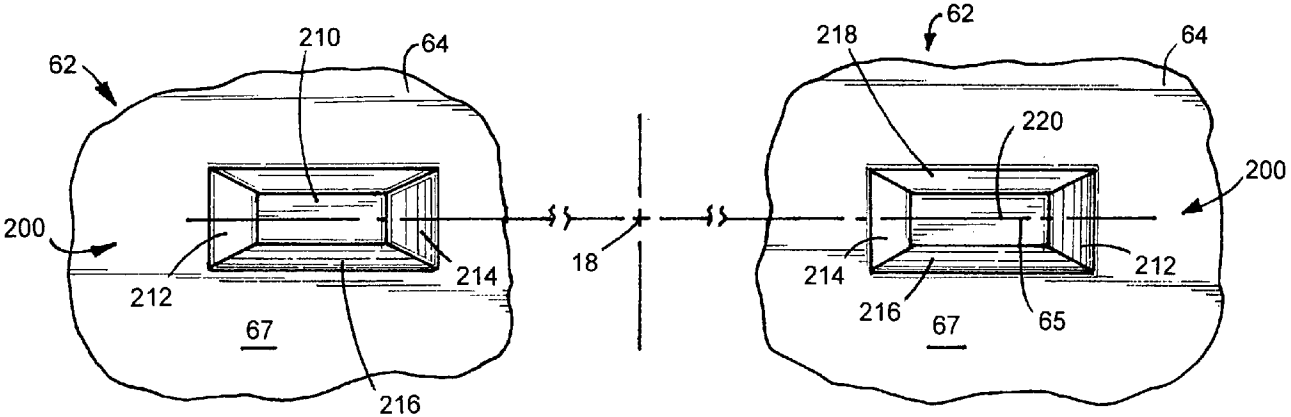
FIG. 16 is a fragmentary bottom plan view of those areas shown in FIG. 15.

In the preferred form shown in FIGS. 15 and 16, the projections 210, 220 forming part of the second set of cooperating instrumentalities 200 include two projections axially extending from the generally flat surface 67 of an elastomer pad 64. To optimize their effect, the projections 210, 220 are disposed to opposed sides of the draft gear assembly longitudinal axis 18. Preferably, the projections 210, 220 axially extending from the generally flat surface 67 of any elastomer pad 64 used in the spring assembly 60 are substantially similar and are axially aligned relative to each other generally along a longitudinal axis 65 (FIG. 16) of the elastomer pad 64. In one form, the projections 210, 220 are formed integral with and during formation of the spring pad 64.

As illustrated by way of example in FIGS. 15 and 16, each projection 210, 220 axially extending from surface 67 of any elastomer pad 64 preferably has a configuration generally corresponding to that discussed above regarding projections 110, 120 extending from surface 82 of the spring seat 80. That is, the projections 210 and 220 on each spring pad 64 each preferably have an elongated generally rectangular configuration although other configurations, i.e. square, cylindrical, or triangular, etc. would equally suffice without detracting or departing from the spirt and scope of this invention disclosure. Like projections 110, 120, each projection 210, 220 extends away from the generally flat lower surface 67 of a pad 64 for a distance ranging between about 7 mm. to about 12 mm. In a most preferred form, each projection 210, 220 axially extends away from surface 67 of a spring unit 64 for a distance of about 10 mm. In one form, each projection 210, 220 has a length ranging between about 35 mm. to about 45 mm. In a most preferred form, each projection 210, 220 has length of about 40 mm. Moreover, each projection 210, 220 has a width ranging between about 15 mm. to about 25 mm. In a most preferred form, each projection 210, 220 has a width of about 20 mm.

As shown in FIG. 16, and based on its generally rectangular configuration, the projections 210, 220 on each spring pad 64 each preferably includes a series of angled surfaces 212, 214, 216 and 218 extending between a distal or free end of the projection and the generally flat surface 67 of the respective elastomer pad 64 for facilitating mating engagement between the projections 210, 220 and the stops 232, 234 on the axially adjacent pad 64 (FIG. 4). Stopping surfaces 212 are provided toward the lateral outermost end of each projection 210, 220 while camming surfaces 214 are provided toward a laterally inward end of each projection 210, 220. As shown in FIG. 15, the camming or stopping surfaces 212 on the lateral outermost end of each projection 210, 220 preferably slant or are angled in opposed directions relative to each other. Moreover, a predetermined distance separates the camming or stopping surfaces 212 on the projections 210, 220. Preferably, the camming surfaces 212 and 214 extend from a distal end of each projection 210, 220 toward the generally flat surface 65 of the spring unit 64 at an angle of about 45 degrees relative to a vertical plane extending generally normal to the generally flat surface 65 on pad 64.

As shown in FIGS. 12 and 16, the camming surfaces 216 and 218 are preferably disposed to opposed sides of each projection 210, 220. In one form, the camming surfaces 216, 218 each extend from a distal end of each projection 210, 220 and toward the generally flat surface 67 of the respective pad 64 at an angle ranging between about 6 degrees and about 10 degrees. In a preferred form, surfaces 216, 218 each extend from a distal end of each projection 210, 220 and toward the generally flat surface 67 of the respective pad 64 at an angle ranging between about 7 degrees relative to a vertical plane extending generally normal to the generally flat surface 67 of the respective pad 64.

To enhance versatility and interchangeability of the pads 64 comprising spring assembly 60, the stops 232, 242 forming part of the second cooperating instrumentalities 200 are preferably configured substantially similar to the stops 132 and 142 on face 65 of the pad 64 at the second end 63 of the spring assembly 60 axially adjacent to the spring seat 80. Preferably, the stops 232 and 242 of the second set of cooperating instrumentalities 200 are arranged in predetermined relation relative to the projections 210 and 220 (FIG. 4), respectively, and relative to the longitudinal axis 18 of the draft gear assembly 10 (FIG. 4). The stops 232, 242 are arranged to opposed sides of the longitudinal axis 18 of the draft gear assembly 10. During assembly and operation of draft gear assembly 10, the stops 232, 242 are designed to engage, mate and positively interlock with the projections 210, 220, respectively, axially extending from an axially adjacent elastomer pad 64.

Figure 17:
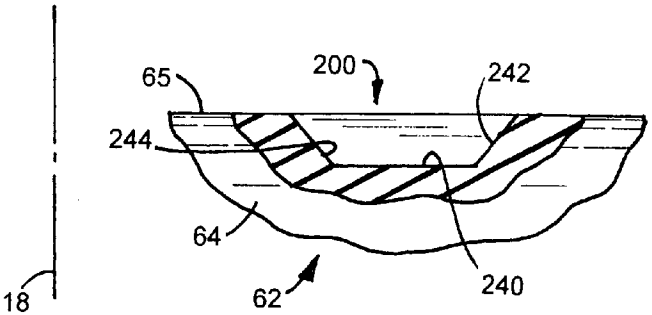
FIG. 17 is a fragmentary sectional view of those areas of the spring unit encircled by phantom lines in FIG. 8.
Figure 17:
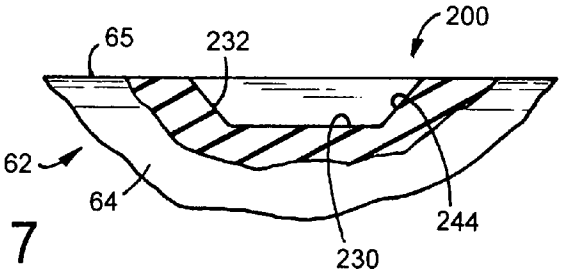
Figure 18:
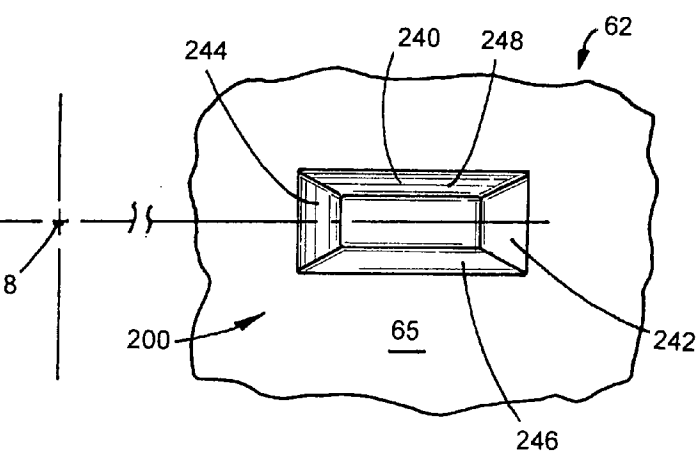
FIG. 18 is a fragmentary top plan view of those areas illustrated in FIG. 17.
Figure 18:
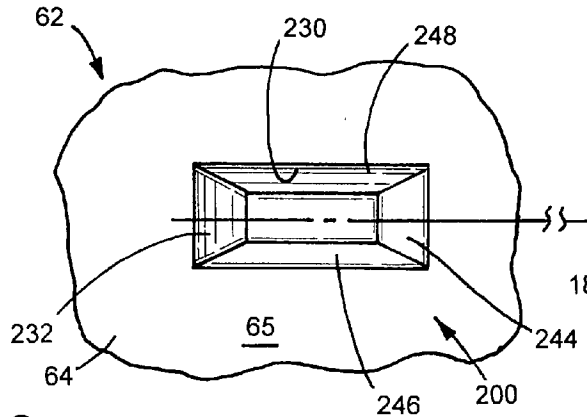

In the embodiment illustrated in FIGS. 17 and 18, the stops 232 and 242 are defined by a pair of recesses 230 and 240 provided on the confronting face 65 of the elastomer pad 64 arranged axially adjacent to the elastomer pad 64 having projections 210, 220 extending from the generally flat surface 65 thereof. In the embodiment shown by way of example, the stops 232, 242 on pad 64 are spaced from each other by the same predetermined distance separating the camming surfaces 212 provided toward the lateral outermost end of each projection 210, 220, respectively (FIG. 4). In one form, the recesses 230 and 240 are provided on the face 65 of the spring pad 64 during formation of the spring unit 62 thereby ensuring accuracy and consistency between pads 64.

In the embodiment illustrated in FIG. 17, the recesses 230, 240 axially extend away from the generally flat surface 65 on pad 64 and are arranged in predetermined relation relative to the projections 210, 220, to each other and relative to the longitudinal axis 18 of the draft gear assembly 10 (FIG. 4). Like the recesses 130, 140 discussed above, the recesses 230, 240 on each pad are substantial mirror images of the respective projection 210, 220 to be accommodated therewithin; with one recess 230, 240 being disposed to each side of the longitudinal axis of the draft gear assembly (FIG. 1). As illustrated by way of example in FIGS. 17 and 18, the recesses 230, 240 on each pad 64 each have an elongated generally rectangular configuration. Of course, if the projections 210, 220 (FIG. 4) would have other configurations, i.e. square, cylindrical, or triangular, etc., the configuration of each recess 230, 240 would also change to be generally reflective thereof.

Preferably, each recess 230, 240 axially extends away from the generally flat surface 65 on pad 64 for a distance ranging between about 7 mm. to about 12 mm. In a most preferred form, each recess 230,240 axially extends away from the generally flat surface 65 on pad for a distance of about 10 mm. In one form, each recess 230, 240 has a length ranging between about 35 mm. to about 45 mm. In a most preferred form, each recess 230, 240 has length of about 40 mm. Moreover, each recess 230, 240 has a width ranging between about 15 mm. to about 25 mm. In a most preferred form, each recess 230, 240 has a width of about 20 mm.

As shown in FIG. 16, and besides defining the stops 232, 242, each respective recess 230, 240 on pad 64 preferably includes a series of camming surfaces 244, 246 and 248 extending from the generally flat surface 65 of the spring pad 64 to facilitate interlocking engagement with the projections 210, 220 extending from the adjacent pad 64. In the embodiment illustrated in FIG. 17, the stops 232, 242 are each slanted at an angle relative to the generally flat surface 65 of the spring pad 64 which is complimentary to the angle of the outermost edges 212 of each projection 210, 220. Similarly, the other camming surfaces 244, 246 and 248 on each recess 230, 240 generally compliment the surfaces 214, 216 and 218 provided on the projections 210, 220 extending from each pad 64 to facilitate mating engagement between the projections 210, 220 and the recesses 230, 240.

When the elastomer pads 64 are layered relative to each other within the spring chamber 30 of housing 16 (FIGS. 3 and 4), the projections 210, 220 on the spring pad 64 at the second end 63 of the spring assembly 60 extend into the recesses 230, 240, respectively, defined by the confronting upper generally flat surface 65 on the axially adjacent elastomeric pad 64 such that the stopping surfaces 212 on the projections 210, 220 operably engage and interlock with the stops 232, 242, respectively, on the adjacent pad 64 whereby restraining longitudinal movement therebetween while maintaining adjacent pads 64 of the spring assembly 60 in predetermined alignment relative to each other and relative to the longitudinal axis 18 of the draft gear assembly 10. Moreover, and when the elastomer pads 64 are layered relative to each other within the spring chamber 30 of housing 16 (FIGS. 3 and 4), the projections 210, 220 on the spring pad 64 adjacent to the second end 63 of the spring assembly 60 extend into the recesses 230, 240, respectively, defined by the confronting upper generally flat surface 65 on the axially adjacent elastomeric pad 64 such that the side faces 216 and 218 on the projections 210, 220 engage and interlock with the side faces 246 and 248 defined by the recesses 230 and 240, respectively, on the axially adjacent elastomeric pad 64 whereby restraining lateral movement of the pads relative to each other while maintaining while maintaining adjacent pads 64 of the spring assembly 60 in predetermined alignment relative to each other and relative to the longitudinal axis 18 of the draft gear assembly 10.

Returning to FIG. 3, in accordance with yet another aspect of the present invention disclosure, there is provided another or third set of cooperating instrumentalities generally identified by reference numeral 300 and preferably disposed between the elastomer pad 64 at the first end 61 of spring assembly 60 and the end wall 22 of housing 16 for effecting axial alignment of the spring assembly 60 relative to the longitudinal axis 18 of the draft gear assembly 10. This third set of cooperating instrumentalities 300 furthermore serves to inhibit shifting movements of the elastomeric spring unit 64 at the first end of the spring assembly 60 relative to the housing 16 and the longitudinal axis 18 of draft gear assembly 10. In one form, the third set of cooperating instrumentalities 300 for effecting axial alignment of the spring assembly 60 relative to the longitudinal axis 18 of the draft gear assembly 10 are defined by and between the elastomer pad 64 at the first end 61 of spring assembly 60 and the closed end 20 of draft gear housing 16.

Figure 21:
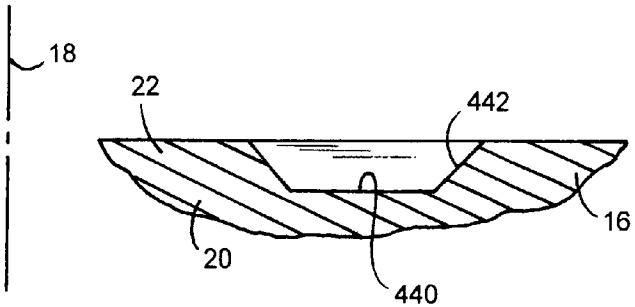
FIG. 21 is a fragmentary sectional view of those areas of the housing end wall encircled by phantom lines in FIG. 3.
Figure 21:
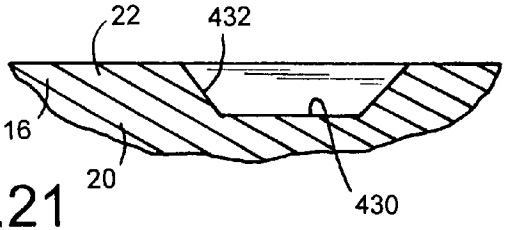
Figure 22:
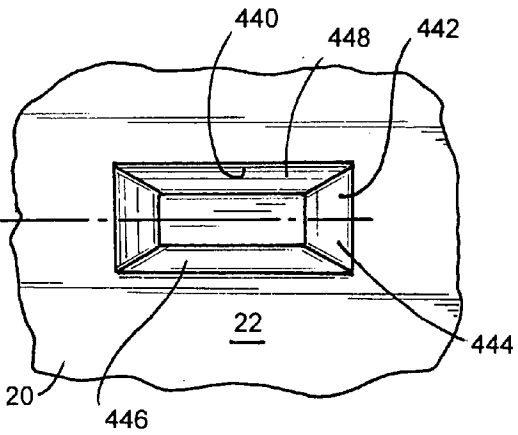
FIG. 22 is a top plan view of those areas of the housing end wall shown in FIG. 21.
Figure 22:
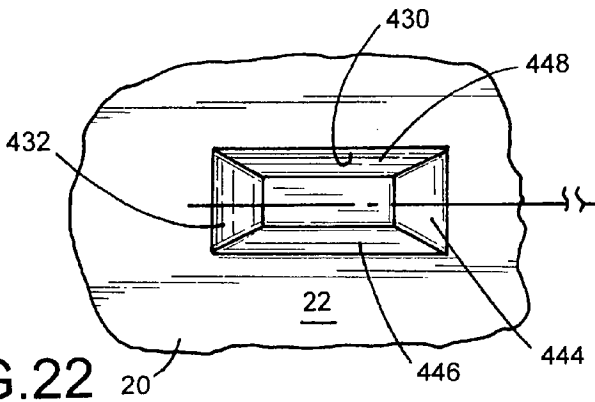

In the illustrated embodiment, the third set of cooperating instrumentalities 300 include a plurality of projections 310 and 320 (FIGS. 3 and 19) axially extending from the generally flat surface 67 of the elastomer pad 64 at the first end 61 of the spring assembly 60 and a plurality of stops 432 and 442 (FIG. 3) defined by the end wall 22 of the draft gear housing 16 (FIGS. 3, 21 and 22). The projections 310, 320 and stops 432, 442 are arranged in predetermined relation relative to each other and relative to the longitudinal axis 18 of the draft gear assembly 10.

Figure 19:
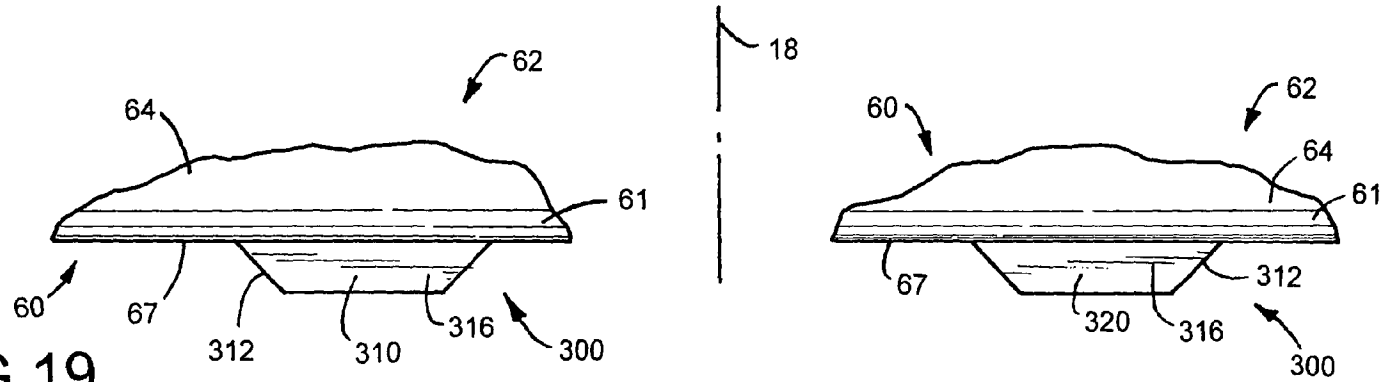
FIG. 19 is a fragmentary elevational view of those areas of the spring unit encircled by dash lines in FIG. 8.
Figure 20:
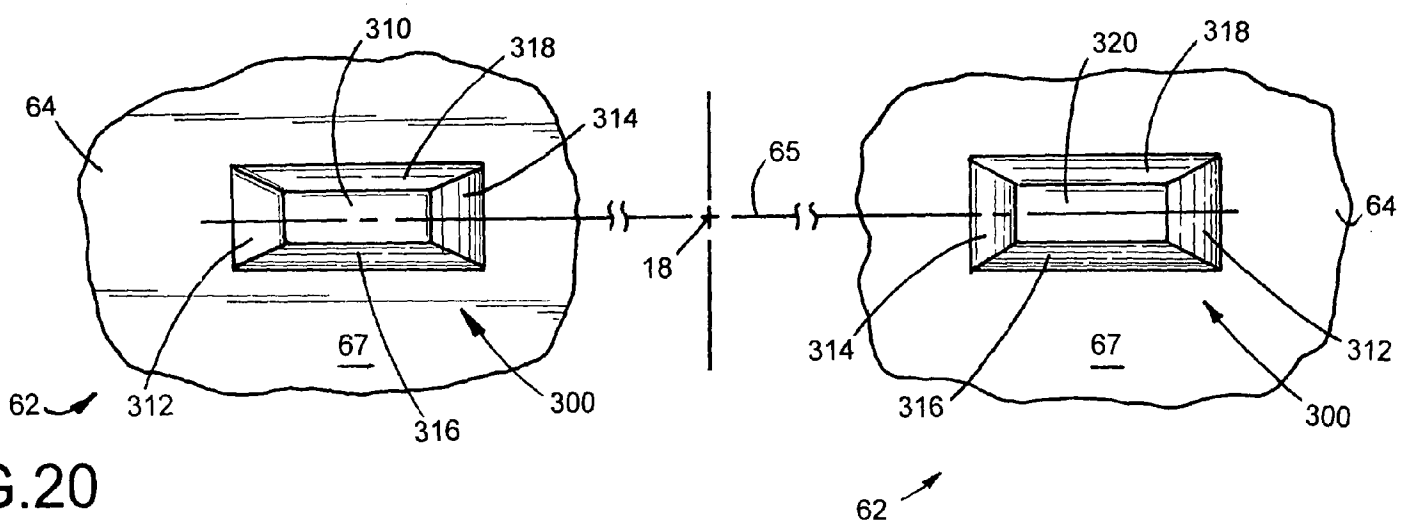
FIG. 20 is a fragmentary bottom plan view of those areas shown in FIG. 19.

To enhance versatility and interchangeability of the pads 64 comprising the spring assembly 60, and in the preferred form shown in FIGS. 19 and 20, the projections 310, 320 forming part of the cooperating instrumentalities 300 are substantially identical to the projections 210, 220 discussed above. That is, in a preferred embodiment, there are two projections axially extending axially from the generally flat surface 67 of the elastomer pad 64 adjacent to the first end 61 of the spring assembly 60. To optimize their effect, the projections 310, 320 are disposed to opposed sides of the draft gear assembly longitudinal axis 18. Like the projections 210, 220 discussed above, the projections 310, 320 are substantially similar and are axially aligned relative to each other generally along a longitudinal axis 65 of the elastomer pad 64.

As illustrated by way of example in FIGS. 19 and 20, each projection 310, 320 extending from the generally flat surface 67 of the pad 64 adapted to be arranged in confronting relation relative to housing end wall 22 preferably has a configuration generally corresponding to that discussed above regarding projections 210, 220 extending from face 67 of any other elastomer pad 64 comprising spring assembly 60. That is, the projections 310 and 320 on pad 64 each preferably have an elongated generally rectangular configuration although other configurations, i.e. square, cylindrical, or triangular, etc. would equally suffice without detracting or departing from the spirt and scope of this invention disclosure. Like projections 210, 220, each projection 310, 320 extends away from the generally flat surface 67 of pad 64 for a distance ranging between about 7 mm. to about 12 mm. In a most preferred form, each projection 310, 320 extends away from the generally flat surface 67 of the end spring unit 64 for a distance of about 10 mm. In one form, each projection 310, 320 has a length ranging between about 35 mm. to about 45 mm. In a most preferred form, each projection 310, 320 has length of about 40 mm. Moreover, each projection 310, 320 has a width ranging between about 15 mm. to about 25 mm. In a most preferred form, each projection 310, 320 has a width of about 20 mm. Like the projections 210, 220 discussed above, the projections 310, 320 on the pad 64 at the first end of the spring assembly 60 are preferably formed integral with and formation of spring unit 62.

As shown in FIG. 20, and based on its generally rectangular configuration, the projections 310, 320 on the spring pad 64 arranged adjacent the first end 61 of the spring assembly 60 each preferably includes a series of angled surfaces 312, 314, 316 and 318 extending between a distal or free end of the projection and the generally flat surface 67 of pad 64 for facilitating mating engagement with the stops 432, 434 on end wall 22 of housing 16. The camming surfaces 312 are provided toward the lateral outermost end of each projection 310, 320 while camming surfaces 314 are provided toward a laterally inward end of each projection 310, 320. As shown in FIG. 19, the camming surfaces 312 on the lateral outermost end of each projection 310, 320 preferably slant or are angled in opposed directions relative to each other. Moreover, a predetermined distance separates the camming surfaces 312 on the projections 310, 320. Preferably, the camming surfaces 312 and 314 extend from a distal end of each projection 310, 320 toward the generally flat surface 65 of unit 64 at an angle of about 45 degrees relative to a plane extending generally normal to the generally flat surface 65 on the pad 64.

As shown in FIGS. 12 and 20, the camming surfaces 316 and 318 are preferably disposed to opposed sides of each projection 310, 320. In one form, the camming surfaces 316, 318 each extend from a distal end of each projection 310, 320 and toward the generally flat surface 65 of pad 64 at an angle ranging between about 6 degrees and about 10. In a preferred form, surfaces 316, 318 each extend from a distal end of each projection 210, 220 and toward the generally flat surface 65 of pad 64 at an angle ranging between about 7 degrees relative to a vertical plane extending generally normal to the surface 65 of pad 64.

To accommodate the projections 310, 320, the stops 432, 442 forming part of the third set of cooperating instrumentalities 300 are preferably configured like the stops 132 and 142 on the pad 64 at the second end 63 of the spring assembly 60 which are configured to coact with the projections 110, 120 extending from the spring engaging surface 82 on the spring seat 80. Suffice it to say, the stops 432 and 442 of the third set of cooperating instrumentalities 300 are arranged in predetermined relation relative to the projections 310 and 320 (FIGS. 19 and 20), respectively, and relative to the longitudinal axis 18 of the draft gear assembly 10 (FIG. 4). The stops 432, 442 are arranged to opposed sides of the longitudinal axis 18 of the draft gear assembly 10 and are designed to engage, mate and positively interlock with the projections 310, 320, respectively, axially extending from an axially adjacent elastomer pad 64 during assembly and operation of draft gear assembly 10.

In the embodiment illustrated in FIGS. 21 and 22, the stops 432 and 442 are defined by a pair of recesses 430 and 440 defined by the end wall 22 of housing 16. Preferably, the recesses and 440 defining stops 432 and 442, respectively, are arranged along in general alignment with a parting line on the housing end wall 22. In the embodiment shown by way of example, the stops 432, 442 on the end wall 22 of housing 16 are spaced apart from each other by the same predetermined distance separating the camming surfaces 312 provided toward the lateral outermost end of each projection 310, 320, respectively (FIG. 19).

In the embodiment illustrated in FIG. 21, the recesses 430, 440 axially extend away from the end wall 22 of housing 16 and are arranged in predetermined relation relative to the projections 310, 320, to each other and relative to the longitudinal axis 18 of the draft gear assembly 10. As such, when the projections 310, 320 and stops 432, 442 engage relative to each other (FIG. 3), as when the elastomer pad 64 at the first end 61 of spring assembly 60 and the housing end wall 16 are brought into operable engagement, the projections 310, 320 on the spring unit 64 arranged adjacent to the housing end wall 16 are accommodated within and interlock with the recesses 430, 440, respectively, on the housing end wall whereby restraining movement therebetween while maintaining the spring assembly 60 in predetermined alignment relative to the longitudinal axis 18 of the draft gear assembly 10.

Like recesses 130, 140 discussed above, the recesses 430, 440 on the housing end wall 16 are substantial mirror images of the respective projections 310, 320 to be accommodated therewithin; with one recess 430, 440 being disposed to each side of the longitudinal axis of the draft gear assembly (FIG. 3). As illustrated by way of example in FIGS. 21 and 22, the recesses 430, 440 each have an elongated generally rectangular configuration. Of course, if the projections 310, 320 (FIGS. 19 and 20) on the pad 64 arranged adjacent to the housing end wall 16 would have other configurations, i.e. square, cylindrical, or triangular, etc., the configuration of each recess 430, 440 would also change to be generally reflective thereof.

Preferably, each recess 430, 440 axially extends away from the housing end wall 16 for a distance ranging between about 7 mm. to about 12 mm. In a most preferred form, each recess 430,440 axially extends away from the housing end wall 16 for a distance of about 10 mm. In one form, each recess 430, 440 has a length ranging between about 35 mm. to about 45 mm. In a most preferred form, each recess 430, 440 has length of about 40 mm. Moreover, each recess 430, 440 has a width ranging between about 15 mm. to about 25 mm. In a most preferred form, each recess 430, 440 has a width of about 20 mm.

As shown in FIG. 22, and besides defining the stops 432, 442, each respective recess 430, 440 on the housing end wall 16 preferably includes a series of camming surfaces 444, 446 and 448 extending from the end wall 16 such that a proper interlocking engagement can be facilitated between the projections 310, 320 and the stops 432, 434. In the embodiment illustrated in FIG. 21, the stops 432, 442 are each slanted at an angle relative to the housing end wall 16 which is complimentary to the angle of the outermost edges 312 of each projection 310, 320. Similarly, the other camming surfaces 444, 446 and 448 on each recess 430, 440 generally compliment the surfaces 314, 316 and 318 provided on the projections 310, 320 on the adjacent pad 64.

Upon insertion of the spring pad 64 disposed at the first end 61 of the spring assembly 60 into the spring chamber 30, the projections 310, 320 on the spring pad 64 at the first end 61 of the spring assembly 60 extend into the recesses 430, 440, respectively, defined by the end wall 20 of housing 16 such that the stopping surfaces 312 on the projections 310, 320 on the pad 64 operably engage and interlock with the stops 332, 342, respectively, on the end wall 20 of housing 16 whereby restraining longitudinal movement therebetween while maintaining at least the lower end of the spring assembly 60 in predetermined alignment relative to the longitudinal axis 18 of the draft gear assembly 10. Moreover, and upon insertion of the spring pad 64 disposed at the first end 61 of the spring assembly 60 into the spring chamber 30, the projections 310, 320 on the spring pad 64 disposed at the first end 61 of the spring assembly 60 extend into the recesses 430, 440, respectively, defined by the end wall 20 such that the surfaces 316 and 318 on the projections 310, 320 engage and interlock with the surfaces 446 and 448 defined by the recesses 430 and 440, respectively, on pad 64 whereby restraining lateral movement therebetween while maintaining at least the lower end of the spring assembly 60 in alignment relative to the longitudinal axis 18 of the draft gear assembly 10.

When the multipiece spring assembly is operably arranged in the draft gear housing 16, with the first end 61 of spring assembly 60 arranged in operable combination with the end wall 22 of housing 16 and the second or opposed end 63 of spring assembly 60 arranged in operable combination with the spring seat 80, the first set of cooperating instrumentalities 100 serve to provide lateral and longitudinal restraint of the pad 64 at the second end of the spring assembly 60 relative to the spring seat 80 and relative to the longitudinal axis 18 of the draft gear assembly. Moreover, the second set of cooperating instrumentalities 200 serve to provide lateral and longitudinal restraint between any two axially adjacent pads 64 of the spring assembly 60 relative to each other and relative to the longitudinal axis 18 of the draft gear assembly. Furthermore, the third set of cooperating instrumentalities 300 operably serve to inhibit the elastomer pad 64 at the first end 61 of the spring assembly 60 against lateral and longitudinal shifting movements relative to housing end wall 16 and the longitudinal axis 18 of draft gear assembly 10. By providing these cooperating instrumentalities between the various components, alignment of the spring assembly 60 and the individual pads 64 relative to each other and relative to the longitudinal axis 18 of the draft gear assembly 10 can be accomplished with little increased costs while offering enhanced operating performance characteristics to the draft gear assembly 10.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A railroad freight car draft gear assembly, comprising:

a hollow housing closed at a first end and open toward a second end, said housing defining a longitudinal axis for said draft gear assembly;

a series of friction members radially spaced about said longitudinal axis and arranged in operable combination with the open end of said housing;

a wedge arranged for axial movement relative to the open end of said housing and against which an exterior force can be applied, with said wedge being arranged in operable combination with and is generally aligned relative to the longitudinal axis of said draft gear assembly by said series of friction members;

a spring assembly disposed within said hollow housing for storing energy applied to said wedge during axial compression of said draft gear assembly, with a first end of said spring assembly being arranged in operable contacting relation with the closed end of said housing, and with said spring assembly including a series of elastomer pads arranged in axially stacked relation relative to each other, with each elastomer pad of said spring assembly having generally flat and axially spaced generally parallel first and second surfaces extending in generally normal relation relative to the longitudinal axis of said draft gear assembly, and with confronting generally flat surfaces of two axially adjacent pads contacting each other;

a spring seat assembly arranged within said housing, with said spring seat extending generally normal to the longitudinal axis of said draft gear and defining a generally flat surface arranged in contacting relation with the generally flat surface of the elastomer pad at a second end of the spring assembly; and wherein the spring seat and the elastomer pad at the second end of said spring assembly define a first set of cooperating instrumentalities for aligning said spring seat and said spring assembly relative to the longitudinal axis of said draft gear assembly.

2. The railroad freight car draft gear assembly according to claim 1, wherein the first set of cooperating instrumentalities on the spring seat and the elastomer pad at the second end of said spring assembly comprise projections axially extending from at least one of the spring contacting surface of said spring seat and the generally flat surface on the elastomer pad at the second end of said spring assembly and cooperating stops defined by the other one of the spring contacting surface of said spring seat and the generally flat surface on the elastomer pad at the second end of said spring assembly, with said projections and stops being arranged in predetermined relation relative to each other and the longitudinal axis of said draft gear assembly.

3. The railroad freight car draft gear assembly according to claim 2, wherein the projections and stops comprising said first set of cooperating instrumentalities each define camming surfaces thereon for facilitating mating engagement between the projections and stops when the spring seat and the elastomer pad disposed at the second end of the spring assembly are operably assembled relative to each other.

4. The railroad freight car draft gear assembly according to claim 2, wherein any two axially adjacent elastomer pads of said spring assembly define a second set of cooperating instrumentalities for effecting and maintaining general axial alignment of said elastomer pads relative to each other.

5. The railroad freight car draft gear assembly according to claim 4, wherein the second set of cooperating instrumentalities for effecting and maintaining general axial alignment of said elastomer pads relative to each other comprises projections axially extending from one of the generally flat surfaces on each elastomer pad and a plurality of stops defined by the confronting generally flat surface on the adjacent elastomer pad, with said projections and stops being arranged in predetermined relation relative to each other and the longitudinal axis of said draft gear assembly.

6. The railroad freight car draft gear assembly according to claim 5, wherein the projections and stops comprising said second set of cooperating instrumentalities each define camming surfaces thereon for facilitating mating engagement between the projections and stops when said elastomer pads are operably assembled relative to the draft gear assembly.

7. The railroad freight car draft gear assembly according to claim 5, wherein the projections comprising part of said second set of cooperating instrumentalities include two generally aligned projections arranged on opposed sides of the longitudinal axis of said draft gear assembly and which axially extend from the generally flat surface on each elastomer pad, and the stops comprising part of said second set of cooperating instrumentalities include two spaced apart recesses extending away from the confronting generally flat surface on the adjacent elastomer pad and which are aligned relative to each other, with the spacing between the projections and recesses being generally equal.

8. The railroad freight car draft gear assembly according to claim 1, wherein said wedge defines a throughbore opening to opposite ends of said wedge and, when said wedge is arranged in operable combination with said draft gear assembly, generally aligns with the longitudinal axis of said draft gear assembly.

9. The railroad freight car draft gear assembly according to claim 8, further including an axially elongated guide operably associated with said spring seat and extending generally normal to and away from the spring contacting surface of said spring seat, with said guide having an outer diameter generally equal to or smaller than an inner diameter of the throughbore defined by said wedge such that, when said spring seat and said wedge are arranged in operable combination with said draft gear assembly, said guide extends telescopically into and is axially slidable within the throughbore in said wedge so as to align said spring seat relative to the longitudinal axis of said draft gear assembly.

10. The railroad freight car draft gear assembly according to claim 1, wherein said spring seat has an indicator thereon for facilitating arrangement of said spring seat within said housing.

11. The railroad freight car draft gear assembly according to claim 1, wherein each elastomer pad comprising the spring assembly has a durometer hardness ranging between about 40 and about 65 on a Shore D hardness scale.

12. A railroad freight car draft gear assembly, comprising:

an axially elongated metallic housing having a closed end, an open end, a spring chamber, and a longitudinal axis extending between said ends;

a friction clutch assembly for absorbing axial impacts directed against said draft gear, said friction clutch assembly including a plurality of friction members, with each friction member having an outer surface angled relative to said longitudinal axis and arranged in sliding friction engagement with the open end of said housing, with said friction clutch assembly further including an actuator having a plurality of angled surfaces, with one end of said actuator axially extending beyond the open end of said housing for receiving energy directed axially to draft gear, and with each angled surface on said actuator being arranged in sliding friction engagement with an inner surface on each friction member such that said actuator is generally aligned relative to the longitudinal axis of said draft gear assembly;

a spring assembly centered and fitted within the spring chamber of said housing and comprised of a series of axially stacked individual units for absorbing, dissipating and returning energy imparted to said actuator during operation of said draft gear, with a first end of said spring assembly being arranged in operable contacting relation with the closed end of said housing, and with the individual units of said spring assembly each including an elastomer pad having generally flat and axially spaced generally parallel first and second surfaces extending in generally normal relation relative to the longitudinal axis of said draft gear assembly, and with the generally flat surfaces of two axially adjacent elastomer pads contacting each other;

a spring seat arranged within said housing and having a generally flat surface extending generally normal to the longitudinal axis of said draft gear assembly and arranged in contacting relation with the generally flat surface of the elastomer pad at a second end of the spring assembly; and wherein the spring seat and the elastomer pad at the second end of said spring assembly define a first set of cooperating instrumentalities for generally aligning said spring seat and at least one end of said spring assembly relative to the longitudinal axis of said draft gear assembly.

13. The railroad freight car draft gear assembly according to claim 12, wherein a lengthwise portion of said housing includes two pairs of joined sidewalls extending generally from said closed end toward the open end of said housing so as to provide the spring chamber with a generally rectangular cross-sectional configuration.

14. The railroad freight car draft gear assembly according to claim 13, wherein a peripheral edge of said spring seat has a generally rectangular configuration, in plan, such that said spring seat has a particular orientation when operably arranged within said housing.

15. The railroad freight car draft gear assembly according to claim 14, wherein said spring seat has an indicator thereon for facilitating orientation of said spring seat assembly within said housing.

16. The railroad freight car draft gear assembly according to claim 13, wherein the first set of cooperating instrumentalities comprises projections axially extending from at least one of the spring contacting surface of said spring seat and the generally flat surface on the elastomer pad at the second end of said spring assembly and stops defined by the other one of the spring contacting surface of said spring seat and the generally flat surface on the elastomer pad at the second end of said spring assembly, with said projections and stops being arranged in predetermined relation relative to each other and the longitudinal axis of said draft gear assembly.

17. The railroad freight car draft gear assembly according to claim 16, wherein the projections and stops comprising said first set of cooperating instrumentalities each define camming surfaces thereon for facilitating mating engagement between the projections and stops when the spring seat and the elastomer pad disposed at the second end of the spring assembly are operably assembled relative to each other.

18. The railroad freight car draft gear assembly according to claim 16, wherein the projections comprising part of said first set of cooperating instrumentalities include two generally aligned projections disposed to opposed sides of the longitudinal axis of said spring assembly and axially extending from the spring contacting surface on said spring seat, and the stops comprising part of said first set of cooperating instrumentalities include two recesses extending away from the generally flat surface of the elastomer pad at the second end of said spring assembly and which are aligned relative to each other, with the spacing between the projections and recesses being generally equal.

19. The railroad freight car draft gear assembly according to claim 12, wherein any two axially adjacent individual units of said spring assembly define a second set of cooperating instrumentalities for effecting and maintaining general axial alignment of said elastomer pads relative to each other.

20. The railroad freight car draft gear assembly according to claim 19, wherein the second set of cooperating instrumentalities for effecting and maintaining general axial alignment of said elastomer pads relative to each other comprises projections axially extending from one of the generally flat surfaces on each elastomer pad and a plurality of stops defined by the confronting generally flat surface on the adjacent elastomer pad, with said projections and stops being arranged in predetermined relation relative to each other and the longitudinal axis of said draft gear assembly.

21. The railroad freight car draft gear assembly according to claim 20, wherein the projections and stops comprising said second set of cooperating instrumentalities each define camming surfaces thereon for facilitating mating engagement between the projections and stops when said elastomer pads are operably assembled relative to the draft gear assembly.

22. The railroad freight car draft gear assembly according to claim 20, wherein the projections comprising part of said second set of cooperating instrumentalities includes two generally aligned projections disposed to opposed sides of the longitudinal axis of said draft gear assembly and axially extending from the generally flat surface on each elastomer pad, and with the stops comprising part of said second set of cooperating instrumentalities including two recesses extending away from the confronting generally flat surface on the adjacent elastomer pad and which are aligned relative to each other, with the spacing between the projections and recesses being generally equal.

23. The railroad freight car draft gear assembly according to claim 12, wherein said actuator defines a throughbore opening to opposite ends of said actuator and, when said actuator is arranged in operable combination with said draft gear assembly, generally aligns with the longitudinal axis of said draft gear assembly.

24. The railroad freight car draft gear assembly according to claim 23, further including an axially elongated guide operably associated with said spring seat and extending generally normal to and away from the spring contacting surface of said spring seat, with said guide having an outer diameter generally equal to or smaller than an inner diameter of the throughbore defined by said actuator such that, when said spring seat and said actuator are arranged in operable combination with said draft gear assembly, said guide extends telescopically into and axially slides within the throughbore in said actuator so as to align said spring seat relative to the longitudinal axis of said draft gear assembly.

25. The railroad freight car draft gear assembly according to claim 12, wherein the elastomer pad of each individual unit of the spring assembly has a durometer hardness ranging between about 40 and about 65 on a Shore D hardness scale.

26. A railroad freight car draft gear assembly, comprising:

an axially elongated metallic housing having a closed end, an open end, a spring chamber, with said housing defining a longitudinal axis for said draft gear;

a friction clutch assembly for absorbing axial impacts directed against said draft gear, said friction clutch assembly including a plurality of friction members, with each friction member having an outer surface angled relative to said longitudinal axis and arranged in sliding friction engagement with the open end of said housing, with said friction clutch assembly further including an actuator having a plurality of angled surfaces, with one end of said actuator axially extending beyond the open end of said housing for receiving energy directed axially to draft gear, and with each angled surface on said actuator being arranged in sliding friction engagement with an inner surface on each friction member;

a spring assembly centered and fitted within the spring chamber of said housing and comprised of a series of axially stacked individual units for absorbing, dissipating and returning energy imparted to said actuator during operation of said draft gear, with a first end of said spring assembly being arranged in operable contacting relation with the closed end of said housing, and with the individual units of said spring assembly each including an elastomer pad having generally flat and axially spaced generally parallel first and second surfaces extending in generally normal relation relative to the longitudinal axis of said draft gear assembly, and with the generally flat surfaces of two axially adjacent elastomer pads contacting each other;

a spring seat arranged within said housing and having a generally flat surface extending generally normal to the longitudinal axis of said draft gear assembly and arranged in contacting relation with the generally flat surface of the elastomer pad at a second end of the spring assembly; and wherein an interior surface on a rear wall at the closed end of said housing and a confronting generally flat surface of the elastomer pad at the first end of said spring assembly define a set of cooperating instrumentalities for aligning said spring assembly relative to the longitudinal axis of said draft gear assembly.

27. The railroad freight car draft gear assembly according to claim 26, wherein said set of cooperating instrumentalities for aligning said spring assembly relative to the longitudinal axis of said draft gear assembly comprises projections axially extending from the generally flat surface on the elastomer pad at the first end of said spring assembly and stops defined by the interior surface on the rear wall at the closed end of said housing, with said projections and stops being arranged in predetermined relation relative to each other and the longitudinal axis of said draft gear assembly.

28. The railroad freight car draft gear assembly according to claim 27, wherein the plurality of projections and stops comprising said set of cooperating instrumentalities each define camming surfaces thereon for facilitating mating engagement between the projections and stops when the elastomer pad disposed at the first end of the spring assembly is arranged in operable association with the draft gear housing.

29. The railroad freight car draft gear assembly according to claim 27, wherein the projections comprising part of said set of cooperating instrumentalities includes two projections disposed to opposed sides of the longitudinal axis of said draft gear assembly and which axially extend from the generally flat surface on the elastomer pad at the first end of said spring assembly, with said projections being aligned relative to each other, and with the stops comprising part of said set of cooperating instrumentalities including two recesses extending away from the interior surface on the rear wall at the closed end of said housing and which are aligned relative to the projections extending from the generally flat surface on the elastomer pad at the first end of said spring assembly.

30. The railroad freight car draft gear assembly according to claim 26, wherein any two axially adjacent individual units of said spring assembly define another set of cooperating instrumentalities for effecting and maintaining general axial alignment of said elastomer pads relative to each other.

31. The railroad freight car draft gear assembly according to claim 30, wherein said another set of cooperating instrumentalities for effecting and maintaining general axial alignment of said elastomer pads relative to each other comprises projections disposed to opposed sides of the longitudinal axis of said draft gear assembly and axially extending from one of the generally flat surfaces on each elastomer pad and stops defined by the confronting generally flat surface on the adjacent elastomer pad, with said projections and stops being arranged in predetermined relation relative to each other.

32. The railroad freight car draft gear assembly according to claim 31, wherein the projections and stops comprising said another set of cooperating instrumentalities each define camming surfaces thereon for facilitating mating engagement between the projections and stops when said elastomer pads are operably assembled relative to the draft gear assembly.

33. The railroad freight car draft gear assembly according to claim 31, wherein the projections comprising part of said another set of cooperating instrumentalities includes two spaced apart projections axially extending from the generally flat surface on each elastomer pad and which are aligned relative to each other, and with the stops comprising part of said second set of cooperating instrumentalities including two spaced apart recesses extending away from the confronting generally flat surface on the adjacent elastomer pad and which are aligned relative to each other, with the spacing between the projections and recesses being generally equal.

34. The railroad freight car draft gear assembly according to claim 26, wherein the elastomer pad of each individual unit of the spring assembly has a durometer hardness ranging between about 40 and about 65 on a Shore D hardness scale.

* * * * *